US008081898B2

(12) United States Patent
Batori et al.

(10) Patent No.: US 8,081,898 B2
(45) Date of Patent: Dec. 20, 2011

(54) PROCESS CARTRIDGE AND METHOD FOR REMOVING PROCESSING MEANS FROM PROCESS CARTRIDGE

(75) Inventors: Yoshiyuki Batori, Mishima (JP); Naoya Asanuma, Susono (JP); Nobuyoshi Hara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 145 days.

(21) Appl. No.: 12/277,731

(22) Filed: Nov. 25, 2008

(65) Prior Publication Data

US 2010/0028042 A1 Feb. 4, 2010

(30) Foreign Application Priority Data

Jul. 31, 2008 (JP) ..... 2008-198423

(51) Int. Cl.
*G03G 15/00* (2006.01)
*G03G 21/16* (2006.01)

(52) U.S. Cl. ..... 399/109; 399/111

(58) Field of Classification Search ..... 399/109, 399/111, 113, 117, 119, 277
See application file for complete search history.

(56) References Cited

U.S. PATENT DOCUMENTS

| | | | | |
|---|---|---|---|---|
| 5,911,096 | A | 6/1999 | Batori et al. | 399/111 |
| 5,920,753 | A | 7/1999 | Sasaki et al. | 399/111 |
| 5,930,562 | A | 7/1999 | Noda et al. | 399/114 |
| 5,937,237 | A | 8/1999 | Nonaka et al. | 399/106 |
| 5,940,658 | A | 8/1999 | Yokoi et al. | 399/119 |
| 6,075,957 | A | 6/2000 | Batori et al. | 399/114 |
| 6,101,348 | A | 8/2000 | Nonaka et al. | 399/103 |
| 6,131,007 | A | 10/2000 | Yamaguchi et al. | 399/256 |
| 6,275,668 | B1 | 8/2001 | Batori | 399/90 |
| 6,334,035 | B1 | 12/2001 | Abe et al. | 399/106 |
| 6,363,226 | B1 | 3/2002 | Batori | 399/8 |
| 6,714,746 | B2 | 3/2004 | Morioka et al. | 399/27 |
| 6,735,404 | B2 * | 5/2004 | Higeta et al. | 399/109 |
| 6,931,226 | B2 | 8/2005 | Chadani et al. | 399/109 |
| 6,937,832 | B2 | 8/2005 | Sato et al. | 399/111 |
| 6,963,706 | B2 | 11/2005 | Morioka et al. | 399/111 |

(Continued)

FOREIGN PATENT DOCUMENTS

| | | |
|---|---|---|
| CN | 1728015 | 2/2006 |

(Continued)

OTHER PUBLICATIONS

Japanese Office Actions dated Mar. 9, 2010 and Jun. 8, 2010, in Japanese Application No. 2008-198423, and English-language translations thereof.

(Continued)

*Primary Examiner* — Sandra L Brase
(74) *Attorney, Agent, or Firm* — Fitzpatrick, Cella, Harper & Scinto

(57) ABSTRACT

A process cartridge detachably mountable to a main assembly of an electrophotographic image forming apparatus, includes an electrophotographic photosensitive drum; a charging roller for electrically charging the drum; a drum frame rotatably supporting the longitudinal ends of the charging roller through bearings and rotatably supporting one longitudinal end of the drum; a drum bearing rotatably supporting the other longitudinal end of the drum and connected to the other longitudinal end of the drum frame by an adhesive; a developing roller for developing an electrostatic latent image formed on the drum; a longitudinally movable magnet roller provided inside the developing roller; and first and second side members supporting different longitudinal ends of the magnet roller and connected to different longitudinal ends of a developing device frame.

3 Claims, 25 Drawing Sheets

U.S. PATENT DOCUMENTS

| | | | | |
|---|---|---|---|---|
| 7,062,200 | B2 * | 6/2006 | Ueno et al. | 399/111 |
| 7,079,787 | B2 | 7/2006 | Ogino et al. | 399/111 |
| 7,099,607 | B2 | 8/2006 | Suzuki et al. | |
| 7,127,192 | B2 | 10/2006 | Batori et al. | 399/104 |
| 7,136,604 | B2 | 11/2006 | Chadani et al. | 399/90 |
| 7,200,349 | B2 | 4/2007 | Sato et al. | 399/111 |
| 7,266,326 | B2 * | 9/2007 | Karakama et al. | 399/109 |
| 7,366,439 | B2 | 4/2008 | Anan et al. | |
| 7,418,225 | B2 | 8/2008 | Morioka et al. | 399/274 |

FOREIGN PATENT DOCUMENTS

| | | |
|---|---|---|
| JP | 2000-162860 | 6/2000 |
| JP | 2001-125465 | 5/2001 |
| JP | 2002-221856 | 8/2002 |
| JP | 2002-311714 | 10/2002 |
| JP | 2004-133270 | 4/2004 |
| JP | 2004-279681 | 10/2004 |
| JP | 2005-031652 | 2/2005 |

OTHER PUBLICATIONS

Office Action in Chinese Application No. 200810179734.5, dated Dec. 29, 2010, and English translation thereof.

* cited by examiner (a)

(b)

PROCESS CARTRIDGE AND METHOD FOR REMOVING PROCESSING MEANS FROM PROCESS CARTRIDGE

FIELD OF THE INVENTION AND RELATED ART

The present invention relates to process cartridges, which are removably mountable in the main assembly of an electrophotographic image forming apparatus, and methods for removing processing means from a process cartridge.

In the field of an electrophotographic image forming apparatus which uses an electrophotographic image forming apparatus, a process cartridge system has been in use, which integrally places an electrophotographic photosensitive drum, and processing means for processing the electrophotographic photosensitive drum, in a cartridge which is removably mountable in the main assembly of an electrophotographic image forming apparatus.

Here, a process cartridge is removably mountable in the main assembly of an electrophotographic image forming apparatus. A process cartridge is made up of an electrophotographic photosensitive drum, at least one among various processing means, more specifically, a developing means, a cleaning means, and a charging means, which are for processing the electrophotographic photosensitive drum, and an external shell (cartridge) in which the photosensitive drum and processing means are integrally disposed.

An electrophotographic image forming apparatus means an apparatus which forms an image on recording medium, with the use of an electrophotographic image forming method. As examples of an electrophotographic image forming apparatus, electrophotographic copying machines, electrophotographic printers (LED printers, laser beam printers, etc.), facsimile machines, word processors, etc., may be included.

As the recording means, paper, OHP sheet, etc., may be included.

Further, the main assembly of an electrophotographic image forming apparatus is the portion of an electrophotographic image forming apparatus, which remains after the removal of a process cartridge or process cartridges from the electrophotographic image forming apparatus.

The process cartridge system mentioned above makes it possible for a user to maintain an electrophotographic image forming apparatus without relying on a service person. Thus, the system can drastically improve an electrophotographic image forming apparatus in terms of operability.

Further, an electrophotographic image forming apparatus is for forming an image on recording medium with the use of developer. Ordinarily, therefore, a process cartridge stores developer in addition to having processing means. Thus, as an electrophotographic image employing a process cartridge (process cartridges) are repeatedly used for image formation, the developer stored in the process cartridge reduces due to consumption.

It has been a common practice to remove components from a process cartridge depleted of developer, and reuse the components. Thus, in order to reuse the process cartridge components, various process cartridges which are simple in structure, and various methods for disassembling a process cartridge, have been proposed.

More specifically, a typical cartridge is made up of a developing apparatus unit and a photosensitive drum unit, which are connected to each other by a pair of pins attached to the lengthwise ends of the process cartridge, one for one, so that the two units are allowed to rotationally move relative to each other, and also, so that the developing apparatus unit and photosensitive drum unit can be separated by removing the above described pins. The developing apparatus unit is a processing means.

Further, the development roller is removed after the step for removing the screws from the pair of lengthwise end members of the developing apparatus unit (Japanese Laid-open Patent Application 2001-125465).

Further, the developing apparatus and photosensitive member unit can be separated from each other by removing one of the lengthwise end members which keep the developing apparatus unit and photosensitive drum unit connected to each other.

Further, it has been known that after the disassembly of a used process cartridge, the solid joints between each lengthwise end member and the drum unit framework, and the solid joint portion between each lengthwise member and the developing apparatus framework, are cut with an ultrasonic cutter, milling machine, or the like (U.S. Pat. No. 6,931,226).

However, the process cartridges in accordance with the prior art require a large number of steps to remove their processing means (components) by disassembling the process cartridges.

SUMMARY OF THE INVENTION

The present invention was made in consideration of the technical issues such as those described above.

Thus, the primary object of the present invention is to provide a process cartridge, the processing means (components) of which can be easily removed, and a method for removing processing means from such a process cartridge.

Another object of the present invention is to provide a process cartridge, which is significantly smaller in the number of steps required to remove its processing means (components) by disassembling the process cartridge than process cartridges in accordance with the prior art, and a method for removing processing means from such a process cartridge.

Another object of the present invention is to provide a process cartridge, the process means (components) of which can be removed in the reusable condition, and a method for removing processing means from such a process cartridge.

According to an aspect of the present invention, there is provided a process cartridge detachably mountable to a main assembly of an electrophotographic image forming apparatus, comprising an electrophotographic photosensitive drum; a charging roller for electrically charging said electrophotographic photosensitive drum; a drum frame rotatably supporting one and the other longitudinal end of said charging roller through bearings and rotatably supporting one longitudinal end of said electrophotographic photosensitive drum; a drum bearing member rotatably supporting the other longitudinal end of said electrophotographic photosensitive drum and connected to the other longitudinal end of said drum frame by an adhesive; a developing roller for developing an electrostatic latent image formed on said electrophotographic photosensitive drum; a magnet roller provided inside said developing roller, wherein said magnet roller is movable in the longitudinal direction; a first side member supporting one longitudinal end of said magnet roller and connected to one longitudinal end of a developing device frame; and a second side member supporting the other longitudinal end of said magnet roller and connected to the other longitudinal end of the developing device frame.

According to another aspect of the present invention, there is provided a dismounting method for dismounting a magnet roller from a process cartridge detachably mountable to a main assembly of an electrophotographic image forming apparatus, wherein said process cartridge including an electrophotographic photosensitive drum, a charging roller for electrically charging said electrophotographic photosensitive drum, a drum frame rotatably supporting one and the other longitudinal end of said charging roller through bearings and rotatably supporting one longitudinal end of said electrophotographic photosensitive drum, a drum bearing member rotatably supporting the other longitudinal end of said electrophotographic photosensitive drum and connected to the other longitudinal end of said drum frame by an adhesive, a developing roller for developing an electrostatic latent image formed on said electrophotographic photosensitive drum, the magnet roller provided inside said developing roller, wherein said magnet roller is movable in the longitudinal direction, a first side member supporting one longitudinal end of said magnet roller and connected to one longitudinal end of a developing device frame, a second side member supporting the other longitudinal end of said magnet roller and connected to the other longitudinal end of the developing device frame, a first separating step of inserting a tool between said first side member and said developing device frame and applying a force so as to separate said first side member and said developing device frame from each other, and a second separating step of expanding between said one longitudinal end of said developing device frame and said one longitudinal end of said drum frame to separate the other longitudinal end of said developing device frame and the other longitudinal end of said drum frame from each other, said method comprising a developing roller dismounting step of dismounting said developing roller from said developing device frame; and a magnet roller dismounting step of dismounting said magnet roller from said developing roller by dismounting a flange from said developing roller by applying a force to a longitudinal end portion of said developing roller dismounted from said developing device frame.

According to a further aspect of the present invention, there is provided a dismounting method for dismounting a charging roller from a process cartridge detachably mountable to a main assembly of an electrophotographic image forming apparatus, wherein said process cartridge including, an electrophotographic photosensitive drum, the charging roller for electrically charging said electrophotographic photosensitive drum, a drum frame rotatably supporting one and the other longitudinal end of said charging roller through bearings and rotatably supporting one longitudinal end of said electrophotographic photosensitive drum, a drum bearing member rotatably supporting the other longitudinal end of said electrophotographic photosensitive drum and connected to the other longitudinal end of said drum frame by an adhesive, a developing roller for developing an electrostatic latent image formed on said electrophotographic photosensitive drum, a magnet roller provided inside said developing roller, wherein said magnet roller is movable in the longitudinal direction, a first side member supporting one longitudinal end of said magnet roller and connected to one longitudinal end of a developing device frame, and a second side member supporting the other longitudinal end of said magnet roller and connected to the other longitudinal end of the developing device frame, said method comprising a first separating step of inserting a tool between said first side member and said developing device frame and applying a force so as to separate said first side member and said developing device frame from each other; a second separating step of expanding between said one longitudinal end of said developing device frame and said one longitudinal end of said drum frame to separate the other longitudinal end of said developing device frame and the other longitudinal end of said drum frame from each other; and a charging roller dismounting step of dismounting said charging roller from said drum frame.

The present invention can reduce the number of steps required to disassemble a process cartridge.

The present invention makes it easier to remove processing means (components) from a process cartridge.

Further, the present invention makes it possible to remove processing means (components) from a process cartridge, in the reusable condition.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Figure 1:
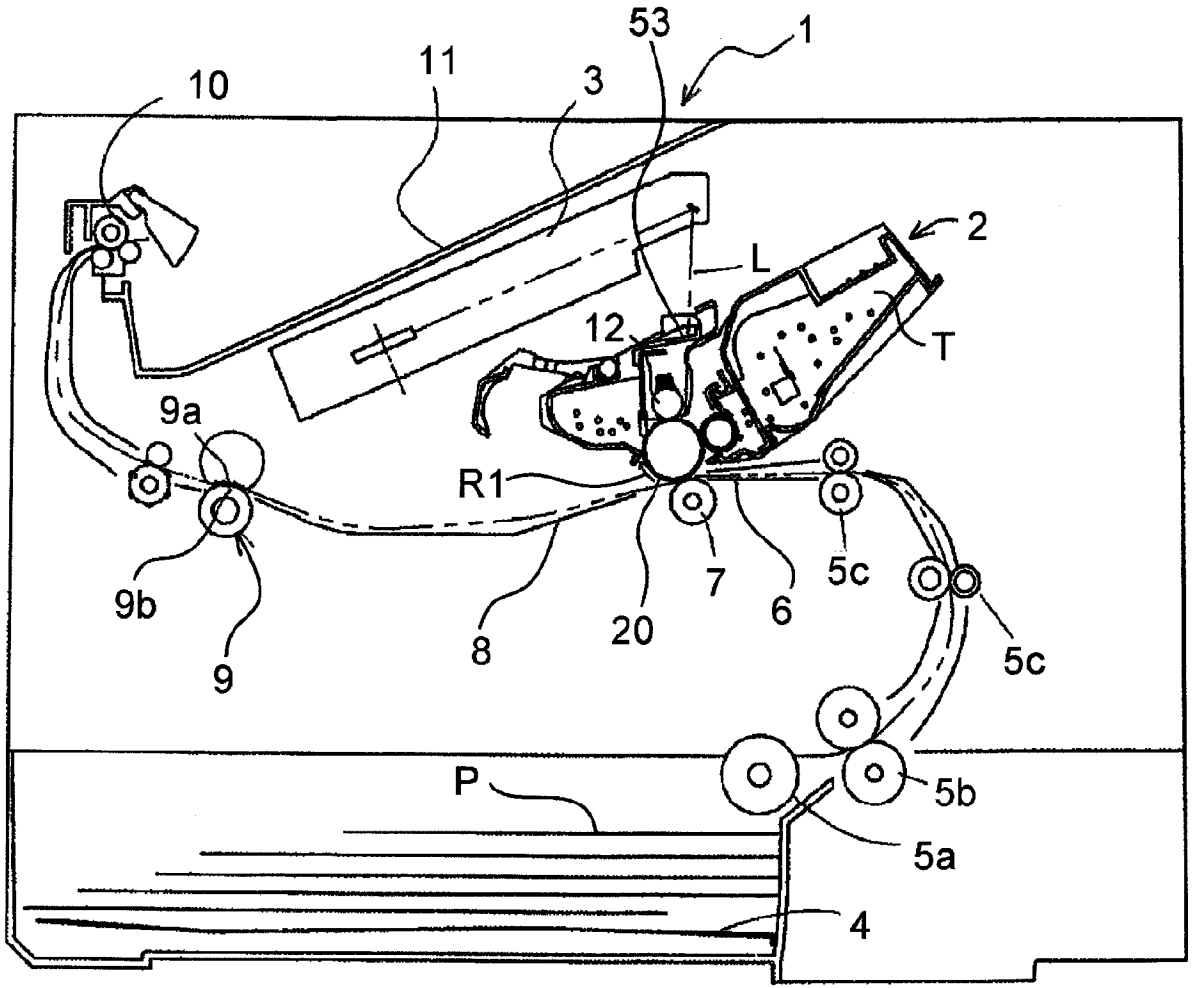
FIG. 1 is a sectional view of an image forming apparatus having a process cartridge in the first embodiment of the present invention.
Figure 2:
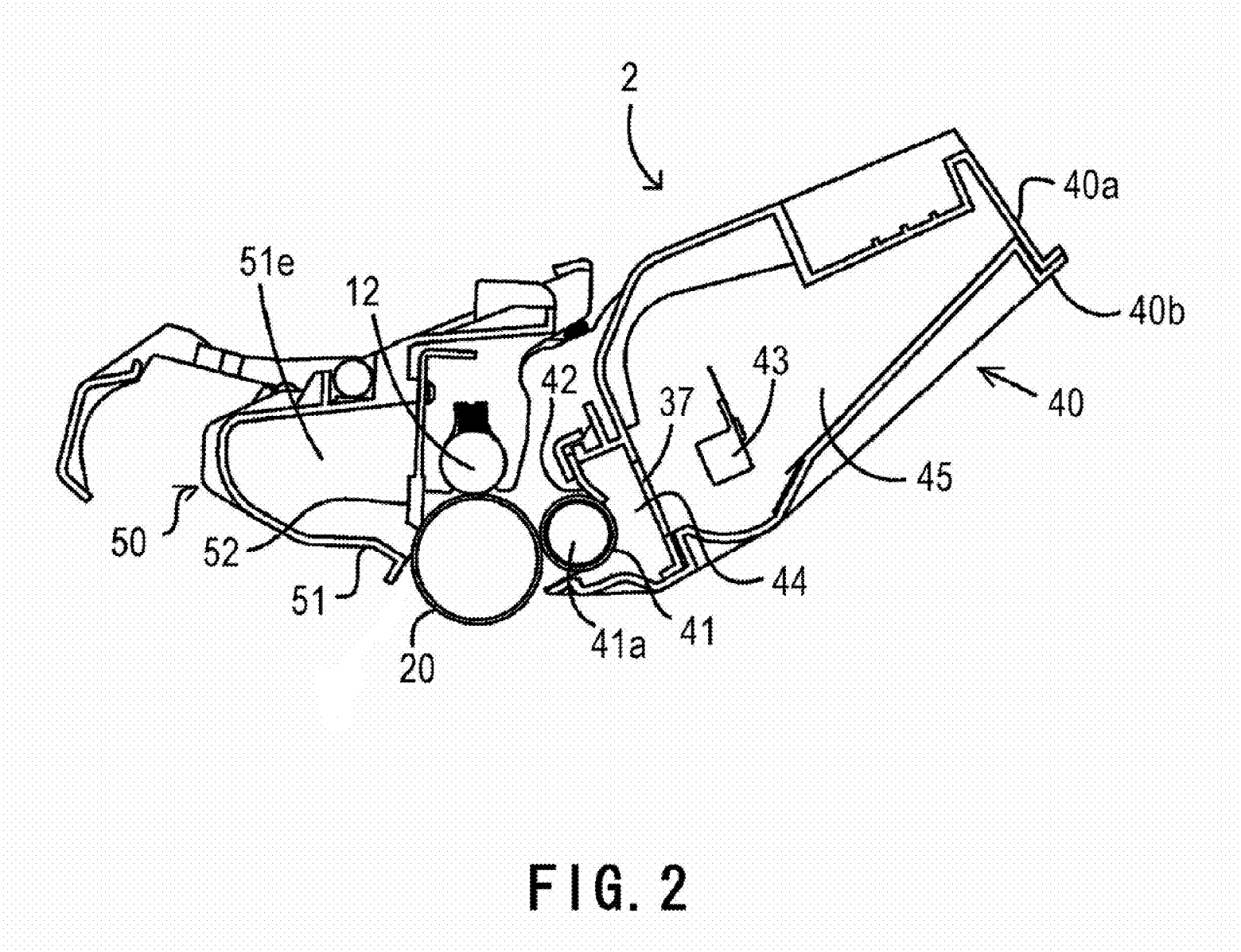
FIG. 2 is an enlarged sectional view of a process cartridge.

Hereinafter, the preferred embodiments of the present invention will be described in detail with reference to the appended drawings. FIG. 1 is a sectional view of the main assembly 1 (which hereafter will be referred to as apparatus main assembly 1) of the image forming apparatus, and the process cartridge (which hereafter will be referred to as cartridge), in the first preferred embodiment of the present invention. FIG. 2 is an enlarged sectional view of the cartridge.

It should be noted here that the functions, materials, shapes of the structural components of the apparatus main assembly 1 and process cartridge 2, and their positional relationships, which will be described hereafter, are not intended to limit the present invention in its scope, unless specifically noted.

Further, once a given member of the apparatus main assembly 1 and process cartridge 2 is described in material, shape, etc., it will be the same in material, shape, etc., throughout the rest of this specification, unless specifically noted. Further, the direction parallel to the rotational axis of the electrophotographic photosensitive drum will be referred to as the lengthwise direction of the electrophotographic photosensitive drum. Regarding the lengthwise ends of the process cartridge 2, electrophotographic photosensitive drum, development roller, charge roller, etc., the lengthwise end where the drum flange for transmitting rotational driving force to the electrophotographic photosensitive drum is located, will be referred to as the second lengthwise end (or second end), and the opposite lengthwise end from the second lengthwise end will be referred to as the first lengthwise end (or first end).

(General Structure)

Referring to FIG. 1, the image forming apparatus is a laser beam printer, which is based on an electrophotographic technology. It employs a cartridge 2, which is removably mountable in the main assembly 1 of the image forming apparatus. The apparatus main assembly 1 is structured so that as the cartridge 2 is mounted into the apparatus main assembly 1, an exposing apparatus 3 (laser scanner) will be above the cartridge 2.

Further, the apparatus main assembly 1 is structured so that when the cartridge 2 is properly positioned in the apparatus main assembly 1, a sheet tray 4, which is for storing sheets of recording medium P on which an image is formed, is below the cartridge 2.

Further, the apparatus main assembly 1 is provided with a pickup roller 5*a*, a recording medium feeding and conveying roller 5*a*, a pair of recording medium conveying rollers 5*b*, a pair of recording medium conveying rollers 5*c*, a transfer guide 6, a transfer charge roller 7, a recording medium conveying guide 8, a fixing apparatus 9, a pair of recording medium discharging rollers 10, a recording medium delivery tray 11, etc., which are placed in the listed order in terms of the direction in which the recording sheet P is conveyed. The fixing apparatus 9 is made up of a fixation roller 9*a* and a pressure application roller 9*b*.

(Description of Image Formation Process)

Next, the image formation process will be roughly described. As a print start signal is inputted, the electrophotographic photosensitive drum 20 (which hereafter may be referred to as drum) is rotationally driven in the direction indicated by an arrow mark R1 at a preset peripheral velocity (process speed).

The peripheral surface of the drum 20 is in contact with the charge roller 12, to which bias voltage is being applied. Thus, the peripheral surface of the drum 20 is uniformly charged by the charge roller 12.

From the exposing apparatus 3, a beam of laser light L is outputted while being modulated with sequential electrical digital picture element signals which reflect the information regarding the image to be formed. The beam of laser light L enters the cartridge 2 through the exposure window 53, with which the top wall of the cartridge 2 is provided, and scans the peripheral surface of the drum 20 (peripheral surface of drum 20 is exposed).

As a result, an electrostatic latent image, which reflects the information of the image to be formed, is formed on the peripheral surface of the drum 20. Next, referring to FIG. 2, this electrostatic latent image is developed into a visible image, that is, an image formed of toner, with the developer (which hereafter may be referred to as toner), in the developing apparatus unit 40.

To describe in more detail, the charge roller 12 is disposed in contact with the drum 20, and charges the drum 20. The charge roller 12 is rotated by the rotation of the drum 20. The developing apparatus unit 40 develops a latent image formed on the drum 20 by delivering toner to the portion of the peripheral surface of the drum 20, which is in the development area.

The developing apparatus unit 40 is made up of a development roller 41, a development blade 42, a stirring member 43, and a toner delivery chamber 44, and a toner storage chamber 45. It sends the toner in the toner storage chamber 45 into the toner delivery chamber 44 by the rotation of the stirring member 43. As the development roller 41, that is, a developer bearing member, which internally holds a magnetic roller 41*a* (stationary magnet), is rotated, a layer of toner is formed on the peripheral surface of the development roller 41 by the development blade 42 while the toner is frictionally charged by the development blade 42.

The electrostatic latent image on the peripheral surface of the drum 20 is developed into a visible image, that is, an image formed of toner, by transferring the toner on the peripheral surface of the development roller 41 onto the drum 20 in the pattern of the latent image. The development blade 42 is a blade for regulating the amount by which toner is allowed to remain on the peripheral surface of the development roller 41 per unit area while frictionally charging the toner (while giving toner triboelectric charge).

Meanwhile, with the same timing as that with which the beam of laser light L is outputted, the sheet P in the bottom portion 1 is conveyed out from the sheet tray 4, into the apparatus main assembly 1 by the pickup roller 5*a*, sheet conveying rollers 5*b*, and sheet conveying rollers 5*c*.

Then, the sheet P is delivered, by way of the transfer guide 6, to the transfer area, that is, the area between the drum 20 and transfer charge roller 7 with the same timing as that with which the toner image on the drum 20 arrives at the transfer area. In the transfer area, the toner image on the drum 20 is transferred onto the sheet P as if it were peeled away from the drum 20.

After the transfer of the toner image onto the sheet P, the sheet P is separated from the drum 20, and is conveyed to the fixing apparatus 9 along the sheet conveyance guide 8. Then, the sheet P is conveyed through the nip between the fixation roller 9*a* and pressure application roller 9*b* of the fixing apparatus 9.

While the sheet P is conveyed through the abovementioned nip, it is subjected to heat and pressure so that the toner image on the sheet P is fixed to the sheet P. After the fixation of the toner image onto the sheet P, the sheet P is conveyed to the pair of discharge rollers 10, and discharged into the delivery tray 11.

Meanwhile, the toner remaining on the peripheral surface of the drum 20 after the transfer of the toner image is removed by the cleaning blade 52 so that the peripheral surface of the drum 20 can be reused for the formation of the next image, which begins from the charging of the peripheral surface of the drum 20. The toner (waste toner) removed from the drum 20 is stored in the waste toner chamber 51*e* of the photosensitive member unit 50.

The charge roller 12, development roller 41, cleaning blade 52, etc., make up the processing means which processes the drum 20.

(Structure of Framework of Process Cartridge)

Figure 3:
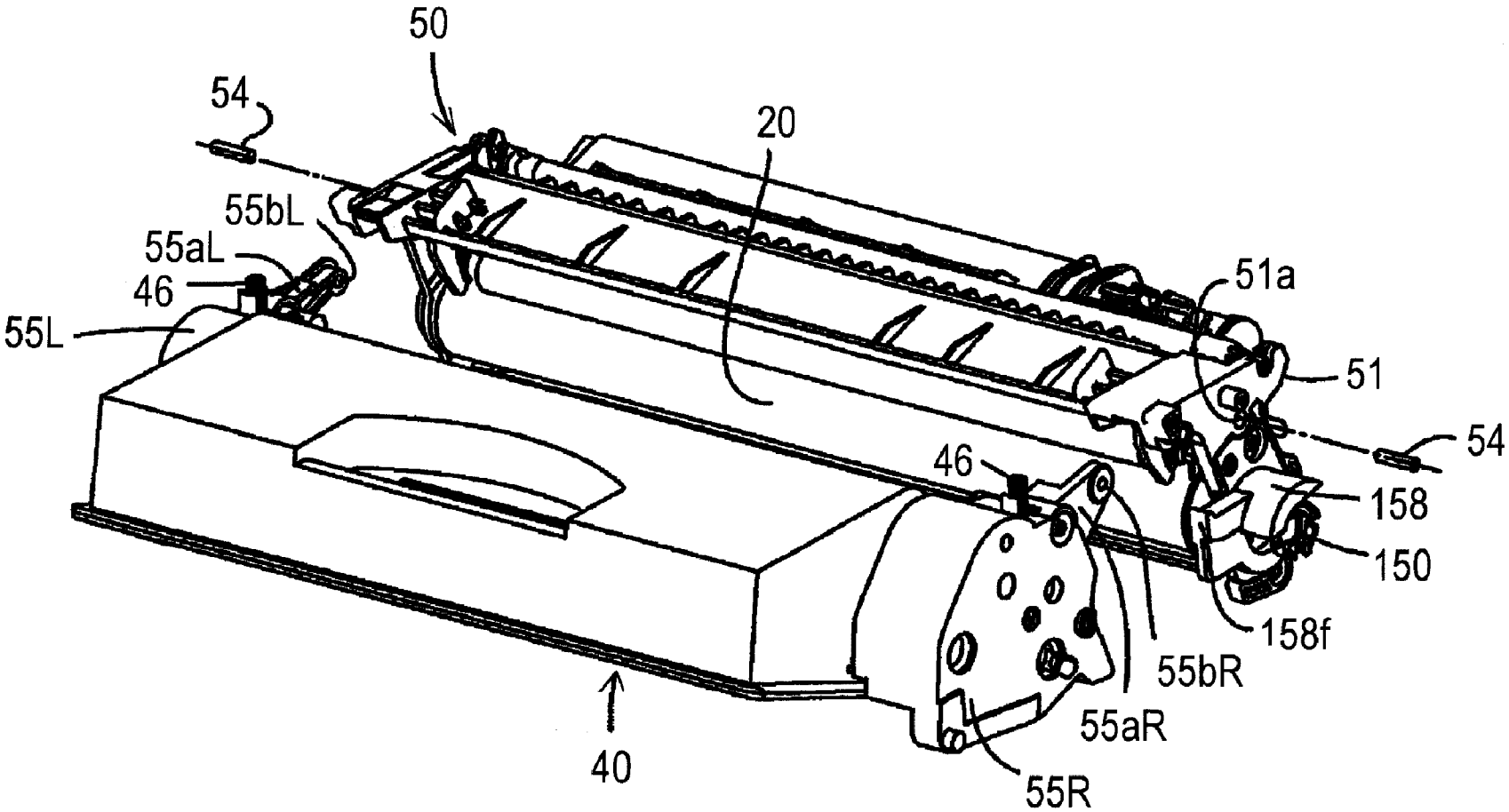
FIG. 3 is a perspective view of a process cartridge, describing the framework structure of the process cartridge.

FIG. 3 is a perspective view of the process cartridge 2, and shows the framework of the cartridge 2. Next, the structure of the framework of the cartridge 2 will be described with reference to FIGS. 2 and 3.

Referring to FIG. 2, the drum 20, charge roller 12, and cleaning blade 52 are integrally attached to the framework 51 of the photosensitive member unit 50, making up the photosensitive member unit 50. The developing apparatus unit 40 is made up of: the toner container 40*a*, which also serves as the framework of the developing apparatus unit 40 having the toner chamber 45, which stores toner, and the toner delivery chamber 44; and a lid 40*b*. The toner container 40*a* and lid 40 are integrated by a means such as welding.

Referring to FIG. 3, the photosensitive member unit 50 and developing apparatus unit 40 are connected to each other with a pair of connective members 54, that is, a pair of round pins, making up the cartridge 2. The two units 50 and 40 are connected so that they are allowed to rotationally move relative to each other.

More specifically, the developing apparatus unit 40 is provided with a pair of lengthwise end members 55L and 55R, which are located at the lengthwise ends of the developing apparatus unit 40, one for one (in terms of direction of axial line of development roller 41). The lengthwise end members 55L and 55R are provided with arm portions 55*a*L and 55*a*R, which are provided with round holes 55*b*L and 55*b*R, respectively, which extend in the direction parallel to the development roller 41.

The arm portions 55*a*R and 55*a*L are inserted into the preset portions of the drum unit framework 51, respectively. As the two arm portions 55*a*R and 55*a*L are inserted, the holes 55*b*R and 55*b*L of the arm portions 55*a*R and 55*a*L align with the holes 51*a*, with which the drum unit framework 51 to accommodate the connective members 54. Incidentally, the hole 51*a* on the first lengthwise end side is not shown in the drawing.

As the connective members 54 are inserted into the holes 55*b*L and 55*b*R, and the holes 51*b* and 51*a* of the drum unit framework, the photosensitive member unit 50 and developing apparatus unit 40 become connected to each other in such a manner that the two units 50 and 40 are rotationally movable relative to each other about the connective members 54.

The substance used as the material for the toner container 40*a*, lid 40*b*, first and second lengthwise end members 55L and 55R is high impact polystyrene (HIPS). It is also high impact polystyrene (HIPS) that is used as the material for the bearing 158 and welding resin, which will be described later.

The cartridge 2 is also provided with a pair of compression coil springs 46, which are attached to the base portions of the arm portions 55*a*L and 55*a*R, one for one. As the two units 50 and 40 are connected to each other, the compression coil springs 46 come into contact with the drum unit framework 51, and keep the developing apparatus unit 40 pressed downward, ensuring that the development roller 41 is kept pressed toward the drum 20. The lengthwise end portions of the development roller 41 are fitted with a pair of gap maintaining members (unshown), one for one, whereby the development roller 41 is held with the presence of a preset amount of gap from the development roller 41.

(Photosensitive Member Unit)

Figure 4:
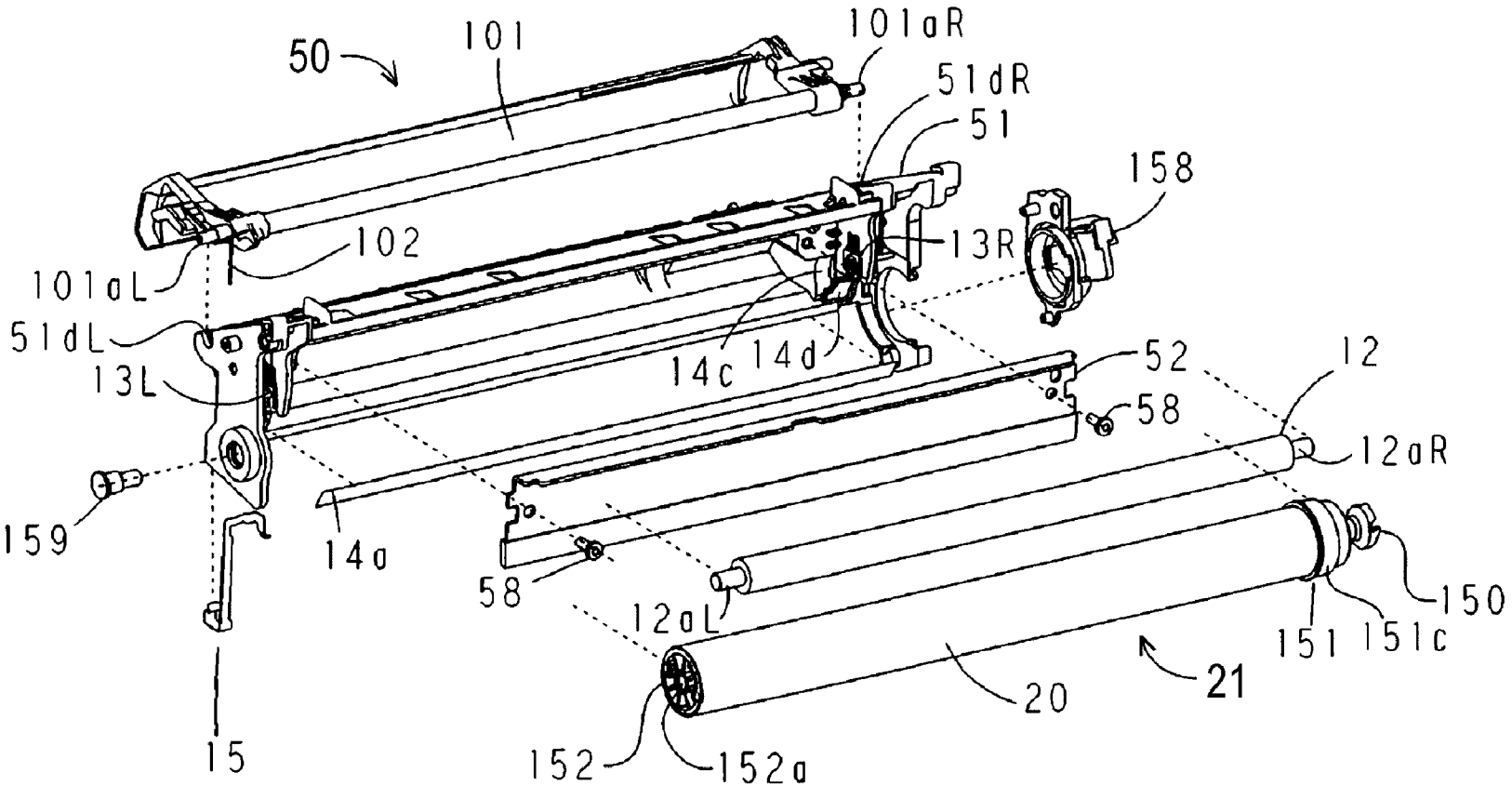
FIG. 4 is an exploded perspective view of the photosensitive member unit, showing how the unit is assembled.

Next, referring to FIGS. 2, and 4-6, the photosensitive member unit 50 will be described in detail. FIG. 4 is an exploded perspective view of the photosensitive member unit 50, and shows how the photosensitive member unit 50 is to be assembled. A toner image formed by developing an electrostatic latent image by the developing apparatus unit 40 is transferred onto the sheet P in the transfer area. Then, the toner remaining on the drum 20 after the transfer is scraped away downward by the cleaning blade 52, is scooped up by a squeegee sheet 14*a*, and stored in the waste toner chamber 51*e* by the squeegee sheet 14*a*.

The cleaning blade 52, squeegee sheet 14*a*, and waste toner chamber 51*e* make up a waste toner removing means. Further, the photosensitive member unit 50 is provided with a first sealing member 14*d* for preventing toner from leaking from the waste toner chamber 51*e* at the backside of each of the lengthwise ends of the cleaning blade 52 formed of rubber, and a second sealing member 14*c* for preventing toner from leaking along the backside of the cleaning blade 52. The first and second sealing members 14*d* and 14*c* are fixed to the preset locations, one for one, of the framework 51 of the photosensitive member unit 50, with the use of two-sided adhesive tape or the like.

The cleaning blade 52 is fixed to a preset portion of the framework 51 of the photosensitive member unit 50, with the use of small screws 58. Further, the first sealing member 14*d* for preventing toner leaking from the waste toner chamber 51*e* at the lengthwise ends of the blade proper (formed of rubber) of the cleaning blade 52, and the squeegee sheet 14*a* which is a member for scooping up the removed toner, are fixed to the framework 51 of the photosensitive member unit 50, with the use of two-sided adhesive tape or the like.

Further, the photosensitive member unit framework 51 is fitted with an electrode 15, and charge roller bearings 13L and 13R. The shaft portions 12*a*L and 12*a*R are fitted into the bearings 13L and 13R, respectively.

The electrophotographic photosensitive drum unit 21 (which hereafter will be referred to as drum unit 21) is provided with a drum flange 152, which is an integral combination of a flange, ground contacts, etc., and is solidly attached to the first lengthwise end of the drum unit 21, that is, the lengthwise end of the drum unit 21, from which the drum unit 21 is not driven. The drum unit 21 is also provided with a drum flange 151, which is solidly attached to the second lengthwise end of the drum unit 21. Further, the drum unit 21 is provided with a rotational force receiving member 150 for receiving rotational force from the apparatus main assembly 1, which is attached to the drum flange 151. The method used for solidly attaching the abovementioned members is crimping, bonding, welding, or the like.

The drum unit 21 is placed in a preset located in the drum unit framework 51 so that the flange 151 rotatably fits in the bearing 158 which has been integrally attached to the drum unit framework 51, at the second lengthwise end.

At first lengthwise end of the drum unit 21, the drum shaft 159 is pressed into the drum unit framework 51, whereas at the second lengthwise end, the drum shaft 159 rotatably fits into the hole 152*a* of the drum flange 152.

As a result, the drum unit 21 becomes rotatably supported by the drum unit framework 51. Further, a spring 102 is attached to the shaft portion 101*a*L of first lengthwise end of a protective member 101. The protective member 101 is for shielding the drum 20 from the external light, and protecting the drum 20 from physical damages. Further, the shaft portion 101*a*L of the protective member 101, and the shaft portion 101*a*R, that is, the shaft portion of the second lengthwise end of the protective member 101, are attached to the bearing portions 51*d*L and 51*d*R of the drum unit framework 51, which are U-shaped in cross section.

(Method for Solidly Attaching Bearings)

Figure 5:
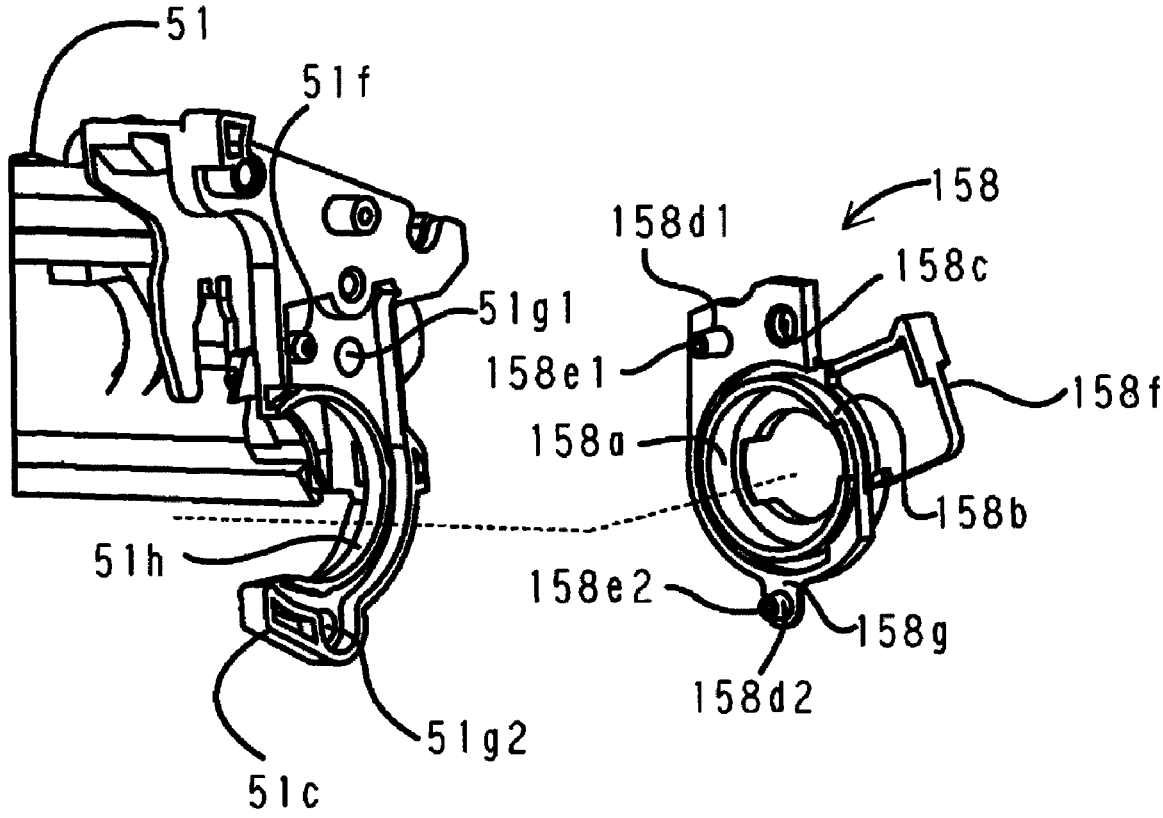
FIG. 5 is a perspective view of the second lengthwise end of the framework of the photosensitive member unit, and the drum bearing, showing how the bearing is solidly attached to the framework.
Figure 6:
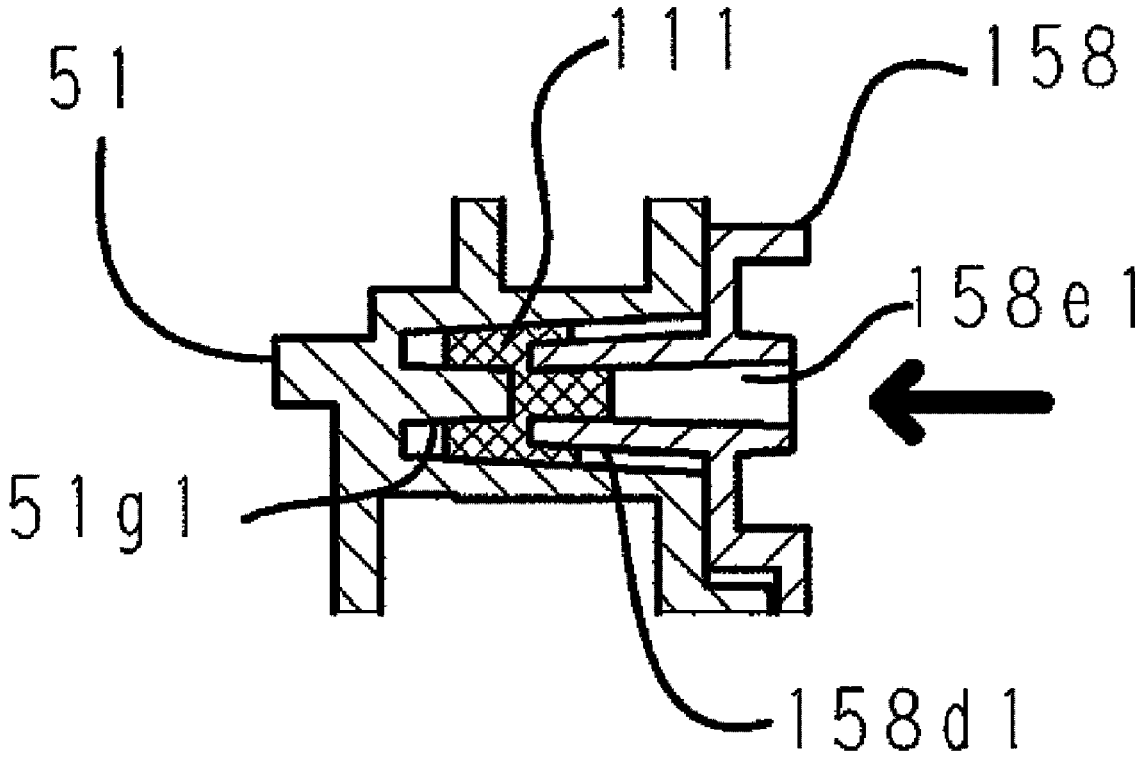
FIG. 6 is a sectional view of the lengthwise second end portion of the drum unit frame work, and the bearing, showing the first connective portion and the first connective hole, respectively.

FIG. 5 is a perspective view of the second lengthwise end of the drum unit framework 51, and the bearing 158, which is for describing the method for solidly attaching the bearing 158 to the drum unit framework 51. FIG. 6 is a sectional view of the second lengthwise end of the drum unit framework 51 and the bearing 158, showing the corresponding first connective portion 158*d*1 and the first connective hole 51*g*1.

Next, referring to FIGS. 5 and 6, the method for solidly attaching the bearing 158 to the drum unit framework 51 will be described. The drum bearing 158 supports the drum unit 21 at the second lengthwise end of the drum unit 21, and is solidly bonded to the second lengthwise end of the drum unit framework 51.

The second lengthwise end portion of the drum unit framework 51 has: a positioning projection 51*f* which projects from the end wall 51*c*, that is, the end wall of the drum unit framework 51, which is on the driving force input side of the process cartridge 2; a first connective hole 51*g*1, that is, a blind hole with which the end wall 51*c* is provided; and a hole 51*h*, which is C-shaped in cross section.

On the other hand, the drum bearing 158 is provided with: a cylindrical shaft-like portion (peripheral surface 158*b* of which fits into the hole 51*h* (C-shaped in cross section)); and a cylindrical positioning hole 158*c*, into which the positioning projection 51*f* of the drum unit framework 51 fits. It is by the provision of these protruding portions and holes that the drum bearing 158 is precisely positioned relative to the drum unit framework 51. Further, the flange 51 is rotatably supported by the inward surface 158*a* of the cylindrical shaft-like portion of the drum bearing 158.

Further, the drum bearing 158 is provided with a first connective portion 158*d*1 and a second connective portion 158*d*2, which are in the form of a projection. Their positioning is such that as the drum bearing 158 is precisely positioned relative to the drum unit framework 51, the first and second connective portions 158*d*1 and 158*d*2 align with the first and second connective holes 51*g*1 and 51*g*2, respectively. The first and second connective portions 158*d*1 and 158*d*2 are provided with through holes 158*e*1 and 158*e*2, respectively.

As a preset amount of melted resin 111 is poured through the through hole 158*e*1 from the direction indicated by an arrow mark in FIG. 6, the surface of the drum unit framework 51 and the surface of the bearing 158, which are facing the melted body (cross-hatched portion in FIG. 6) of resin 111 melt. Then, as the areas between the drum unit framework 51 and bearing 158 are allowed to cool down, the resin solidifies, bonding the drum unit framework 51 and bearing 158 to each other. Similarly, the second connective portion 158*d*2 is bonded to the inward surface of the connective hole 51*g*2, as another body of melted resin 111 is poured into the through hole 158*e*2.

(Developing Apparatus Unit)

Figure 7:
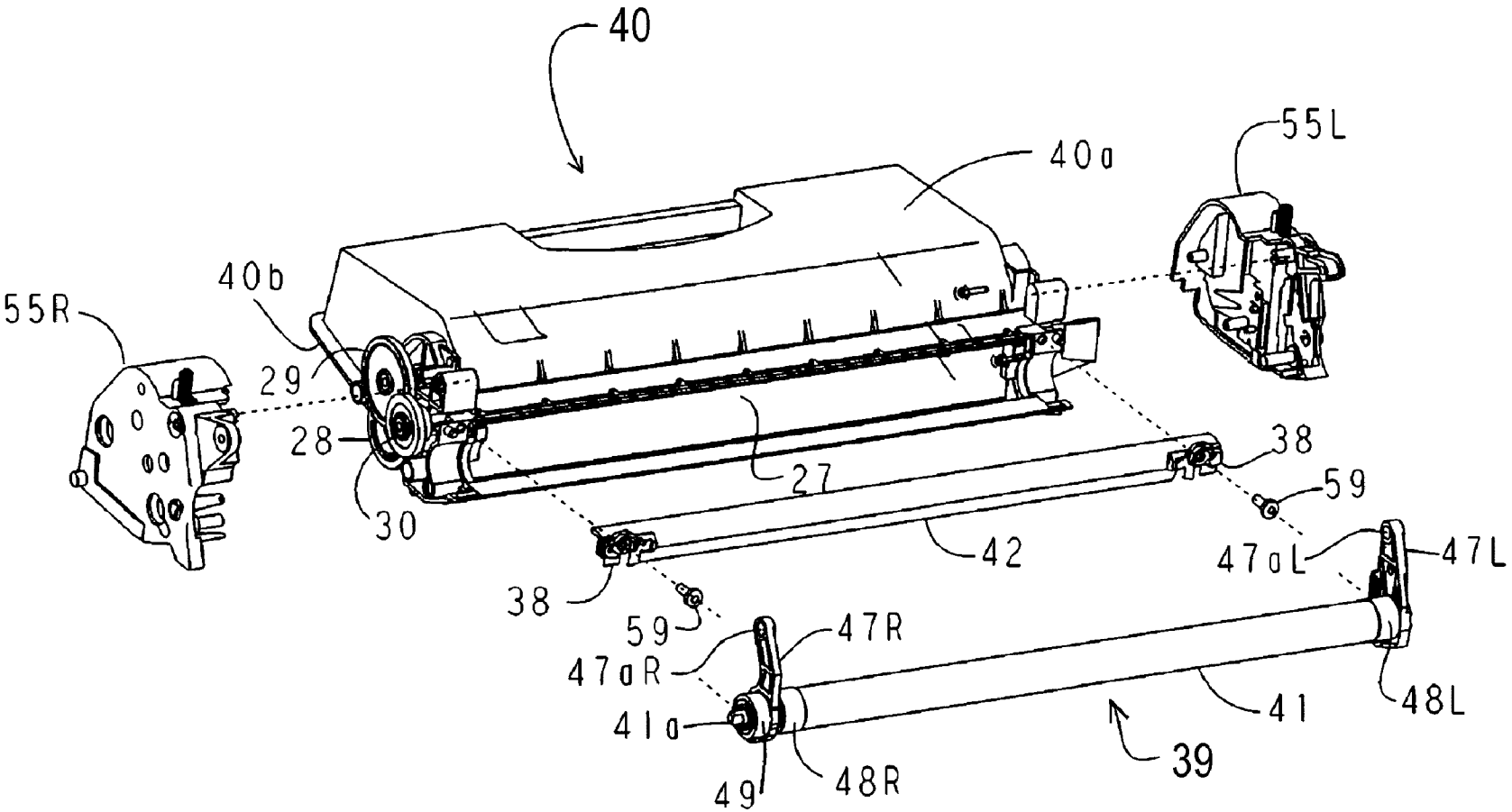
FIG. 7 is a partially exploded perspective view of the developing apparatus unit.

Next, referring to FIGS. 7-11, the developing apparatus unit 40 will be described. FIG. 7 is a perspective view of the developing apparatus unit 40.

The developing apparatus unit 40 has: the toner container 40*a*, which has the toner storage chamber 45; lid 40*b*; and first and second lengthwise end members 55L and 55R. Further, it has: the development roller 41; development blade 42, which is the developer regulating member for regulating in thickness the toner layer on the development roller 41; components for supplying the development roller 41 with electric power; seals for preventing toner from leaking at the lengthwise ends of the development roller 41; etc.

The toner seals 27 are positioned along the four edges of the toner delivery hole 37 (FIG. 2), by being thermally fixed thereto. The developing apparatus unit 40 is also provided with a stiffing member 43, which is in the toner storage chamber 45. The stirring member 43 is supported by the toner container 40*a*, at its lengthwise ends; one of the lengthwise ends is directly supported by the toner container 40*a*, whereas the other is supported by a stirring bear 28 attached to the toner container 40*a*. The stirring member 43 is rotated by the rotation of the stirring gear 28.

Further, the developing apparatus unit 40 is provided with a first gear 30 and a second gear 29, which are rotatably attached to the toner container 40*a*. As these gears 30 and 29 are rotated in mesh with each other, the force for driving the stirring gear 28 is transmitted from the first gear 30 to the second gear 29, and then, to the stirring gear 28.

The toner container 40*a* and lid 40*b* are integrally united to each other by ultrasonic welding. Then, the development blade 42 is solidly fixed, along with a pair of cleaning members 38 for cleaning the peripheral surface of the development roller 41 by being placed in contact therewith, to the toner container 40*a*, by its lengthwise ends, with screws 59.

Next, the development roller unit 39 is placed in the preset location in the developing apparatus unit 40. The development roller unit 39 is made up of the development roller 41 and development roller flange 41*b*. The development roller 41 has a magnetic roller 41*a*, which was inserted into the hollow of the roller portion of the development roller 41 through the opening of one end of the development roller. The opening of the other end is fitted with the development roller flange 41*b*, which was solidly attached to the roller by being pressed into the opening.

Further, the developing apparatus unit 40 is provided with a gap maintaining members 48L and 48R for maintaining a preset amount of gap between the peripheral surface of the drum 20 and development roller 41, and a pair of bearings 47L and 47R, which are located at the first lengthwise end of the developing apparatus unit 40, and the second lengthwise end, respectively.

Further, the second lengthwise end of the development roller 41 is provided with a development roller gear 49, which is in mesh with the gear 151*c* (FIG. 4) of the flange 151, and also, the first gear 30, to transmit rotational force to the development roller 41.

To the first lengthwise end of the toner container 40*a*, the first end member 55L is solidly attached, whereas to the second lengthwise end, the second end member 55R is solidly attached. It is by the first and second end members 55L and 55R that the bearings 47L and 47R located at the first and second lengthwise ends of the development roller unit 39, respectively, are precisely positioned. The development roller 41 is rotatably supported by the bearings 47L and 47R.

(Method for Solidly Attaching Lengthwise End Members)

Figure 8:
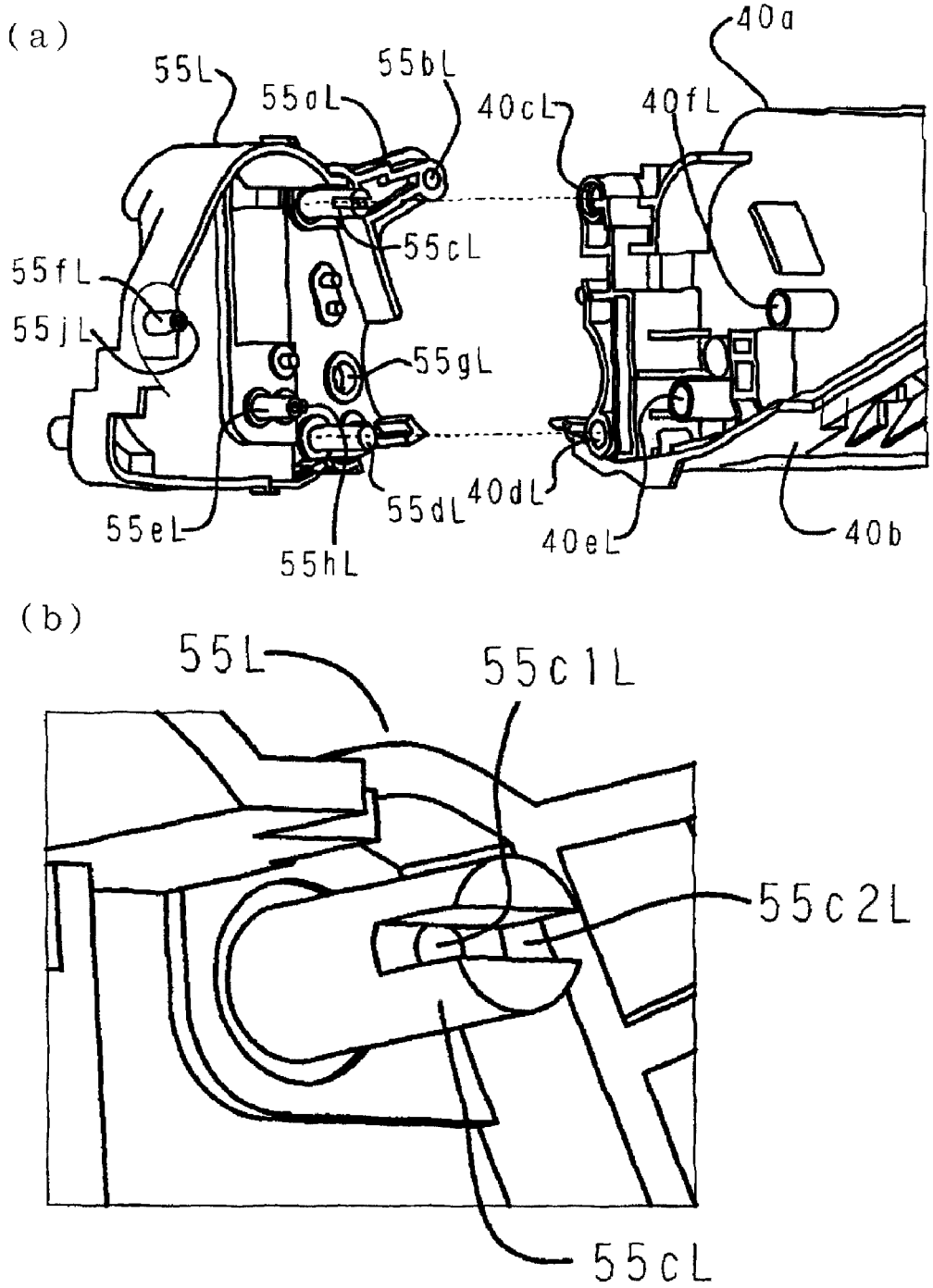
FIG. 8(*a*) is a perspective view of the first lengthwise end of the toner container, and the first lengthwise end member, showing the method for solidly attaching them to each other, and FIG. 8(*b*) is a perspective view of the shaft portion of the first lengthwise end member.
Figure 9:
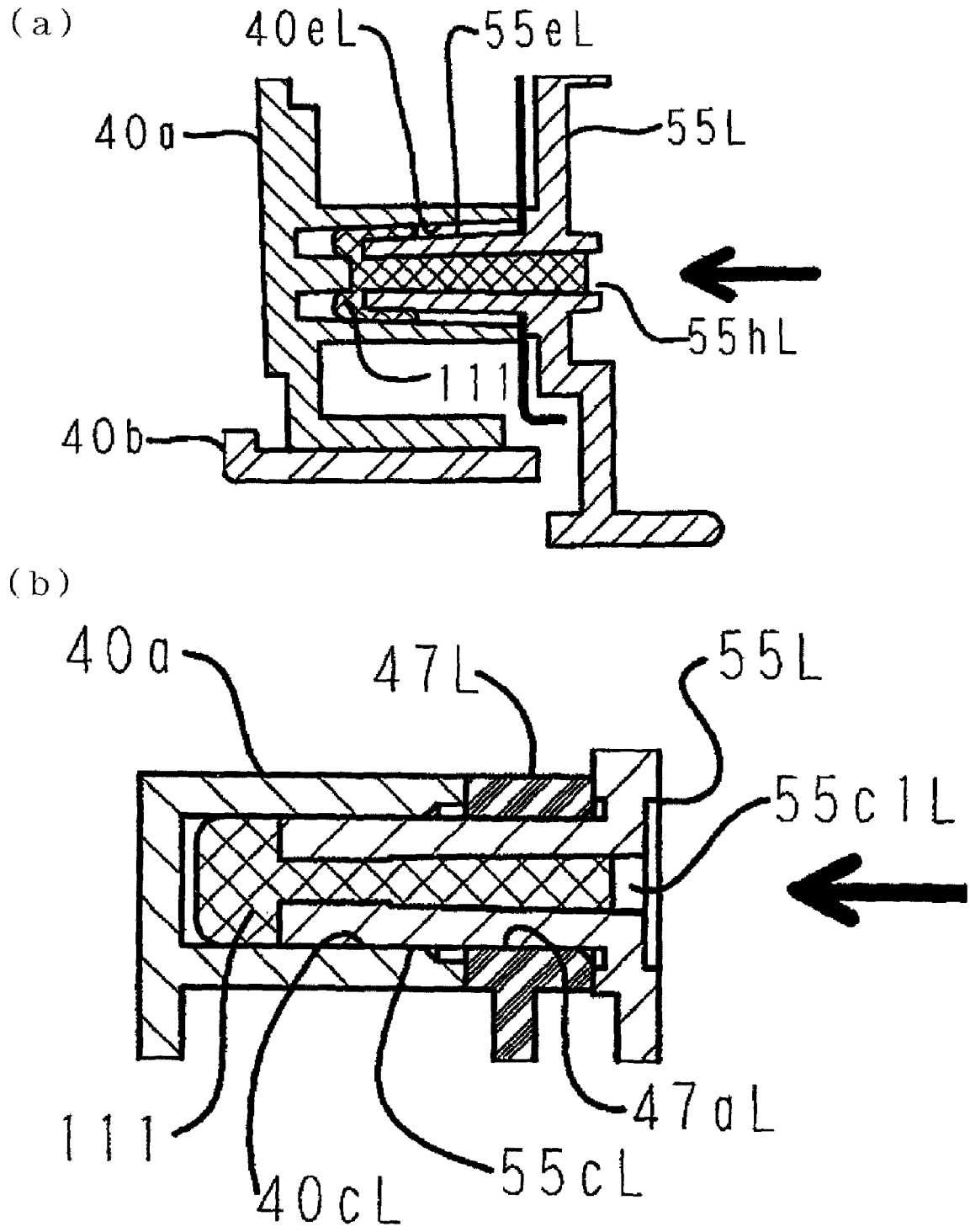
FIG. 9(*a*) is a sectional view of the first lengthwise end member and the first lengthwise end of the toner container, showing the connective portion of the first end member and the connective hole of the container, and FIG. 9(*b*) is a partial sectional view of the first lengthwise end member, and the first lengthwise end of the toner container, showing the shaft portion of the first end member and the positioning hole of the toner storage container.

FIG. 8(*a*) is a perspective view of the toner container 40*a* and first end member 55L, showing the method for solidly attaching the toner container 40*a* and first end member 55L to each other. FIG. 9(*a*) is a sectional view of the first lengthwise end member 55L, and the first lengthwise end of the toner container 40*a*, showing the connective portion 55*e*L of the first end member 55L and the connective hole 40*e*L of the first lengthwise end of the toner container 40*a*.

First, referring to FIG. 8(*a*), the method for solidly attaching the first end member 55L will be described. For the ease of description, FIG. 8(*a*) shows only the toner supply container 40*a*, lid 40*b*, and first end member 55L.

The first end member 55L supports the bearing 47L, and the first end of the magnetic roller 41*a*, and is solidly bonded to the first end of the toner container 40*a*. The first end of the toner container 40*a* is provided with a positioning hole 40*c*L, a positioning hole 40*d*L, a first connective hole 40*e*L, and a second connective hole 40*f*L. The positioning holes 40*c*L and 40*d*L are round blind holes.

Further, the first end member 55L is provided with an arm portion 55*a*L, a shaft 55*c*L, and a shaft 55*d*L. The end portion of the arm 55*a*L is provided with a hole 55*b*L, which is parallel to the development roller 41 and is elongated in cross section. The shafts 55*c*L and 55*d*L project inward from the inward surface of the first end member 55L, and fit into the positioning holes 40*c*L and 40*d*L, respectively.

The shafts 55*c*L and 55*d*L are put through the top and bottom positioning holes 47*a*L (FIG. 7), and then, are fitted into the positioning holes 40*c*L and 40*d*L, respectively.

Further, the first end member 55L is provided with a supportive hole 55*g*L, which is roughly at the mid point between the shafts 55*c*L and 55*d*L. The supportive hole 55*g*L is for supplying the first end of the magnetic roller 41*a*, and is D-shaped in cross section.

Further, the first end member 55L is provided with a first connective portion 55*e*L and second connective portion 55*f*L, the positioning of which is such that as the first end member 55L is precisely positioned relative to the toner container 40*a*, the first and second connective portions 55*e*L and 55*f*L align with the first and second connective holes 40*e*L and 40*f*L of the developing apparatus unit 40.

The first and second connective portions 55*e*L and 55*f*L are provided with through holes 55*h*L and 55*j*L, respectively.

Next, referring to FIG. 9(*a*), the process for bonding the first end portion 55L to the toner container 40*a* with the use of the melted resin, by fitting the first connective portion 55*e*L of the first end portion 55L into the first connective hole 40*e*L of the toner container 40*a*, will be described.

A preset amount of melted resin is injected into the gap between the wall of the connective hole 40*e*1 of the toner container 40*a*, and the connective portion 55*e*1, through the through hole 55*h*L, from the direction indicated by an arrow mark in FIG. 9(*a*), with the first end portion 55L being precisely positioned relative to the toner container 40*a*. As the melted resin is injected, the portion of the wall of the connective hole 40*e*L, which came into contact with the body of melted resin 111 (cross-hatched portion), and the portion of the surface of the connective portion 55*e*L of the first end portion 55L, which came into contact with the body of melted resin 111, melt. Then, as the areas of contact between the first end member 55L and toner container 40*a* cool down, the melted resin 111 solidifies, solidly bonding the first end portion 55L and toner container 40*a* to each other. Similarly, the second connective portion 55*f*L is bonded to the wall of the connective hole 40*f*L, as another body of melted resin 111 is poured into the gap between the wall of the connective hole 40*f*L and connective portion 55*f*L.

As described above, the first end member 55L is solidly attached to the toner container 40*a* by the two positioning portions, with the use of the two bodies of melted resin. Next, the method for ensuring that the shaft 55*c*L is solidly bonded to the wall of the positioning hole 40*c*L, with the use of bonding resin, will be described.

FIG. 8(*b*) is a perspective view of the shaft 55*e*L, and its adjacencies, of the first end member 55L. FIG. 9(*b*) is a sectional view of the shaft 55*c*L of the first end member 55R, bearing 47L, and positioning hole 40*c*L of the first lengthwise end of the toner container 40*a*.

First, referring to FIG. 8(*b*) which is an enlarged perspective view of the shaft 55*c*L of the first end member 55L, and its adjacencies, the shaft 55*c*L will be described. The shaft 55*c*L is provided with a through hole 55*c*1L, the axial line of which coincides with the axial line of the shaft 55*c*L. This hole 55*c*1L is for injecting melted resin. The diameter ϕ of its entrance (outward side) is 2 mm, and the diameter ϕ of its inward end (inward side) is 1.7 mm. In other words, the hole 55*c*1L is tapered.

Further, the inward end portion of the shaft 5*c*L is provided with a slit 55*c*2L, which is the passage for the melted resin. The slit 55*c*2L is 1.5 mm in width and 4 mm in depth.

Next, referring to FIG. 9(*b*), the process of bonding the shaft 55*c*L to the surface of the positioning hole 40*c*L with the use of resin will be described.

After the shaft 55*c*L is put through the positioning hole 47*a*L of the bearing 47L, it is fitted into the positioning hole 40*c*L. Then, a preset amount of melted resin is injected into the gap between the shaft 55*c*L and the wall of the positioning hole 40*c*L through the through hole 55*c*1L from the direction indicated in FIG. 9(*b*) by the arrow mark. As the melted resin is injected, the portion of the toner container 40*a*, which is in contact with the body of melted resin 111, and the portion of the first end member 55L, which is in contact with the body of melted resin 111, melt. Then, as the body of melted resin 111 is allowed to cool down, the melted resin 111 solidifies, solidly bonding thereby the shaft 55*c*L to the wall of the positioning hole 44*c*L.

As described above, the shaft 55*c*L and the wall of the positioning hole 40*c*L, which are for precisely positioning the first end member 55L and toner container 40*a* relative to each other, are bonded with the use of melted resin, leaving therefore no gap between the shaft 55*c*L and the wall of the positioning hole 40*c*L. Therefore, it is ensured that the bearing 47L remains solidly attached to the toner container 40*a*.

Figure 10:
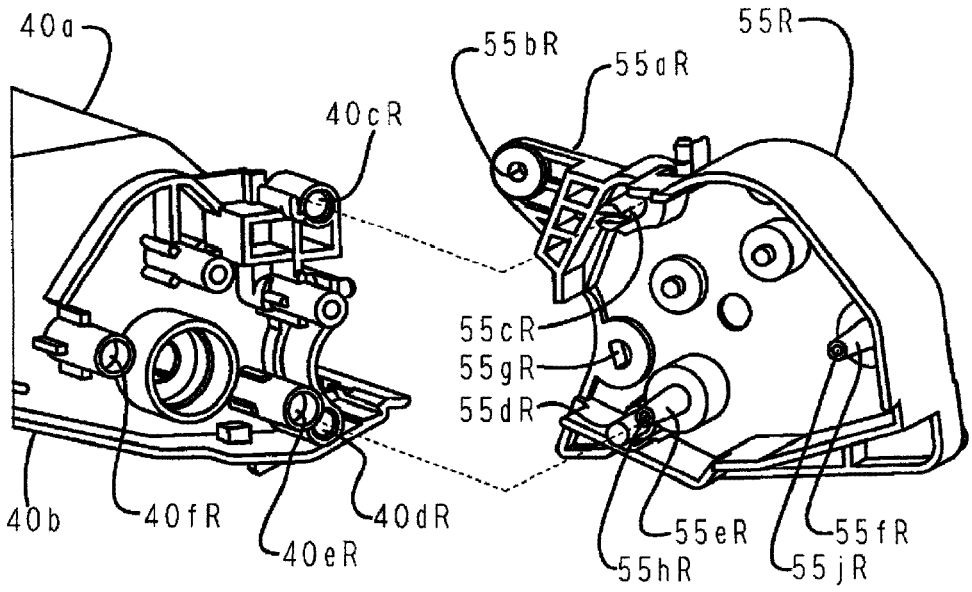
FIG. 10(*a*) is a perspective view of the second lengthwise end of the toner container and the second lengthwise end member, showing the method for solidly attaching them to each other, and FIG. 10(*b*) is a perspective view of the second lengthwise end member and its shaft.
Figure 10:
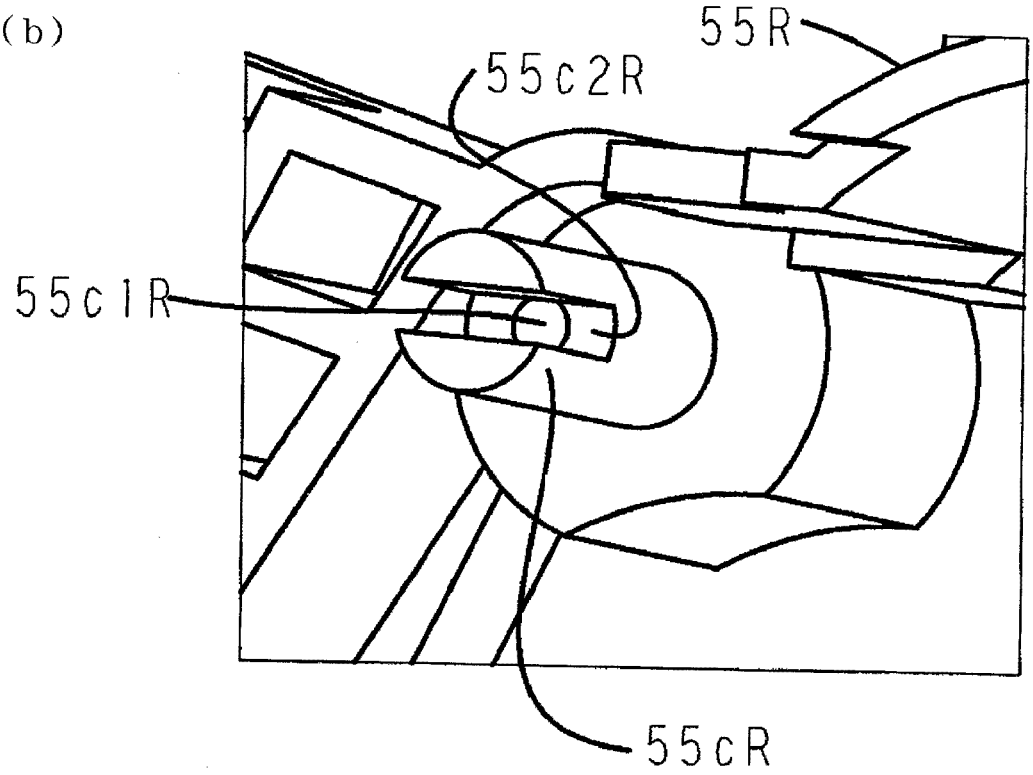
Figure 11:
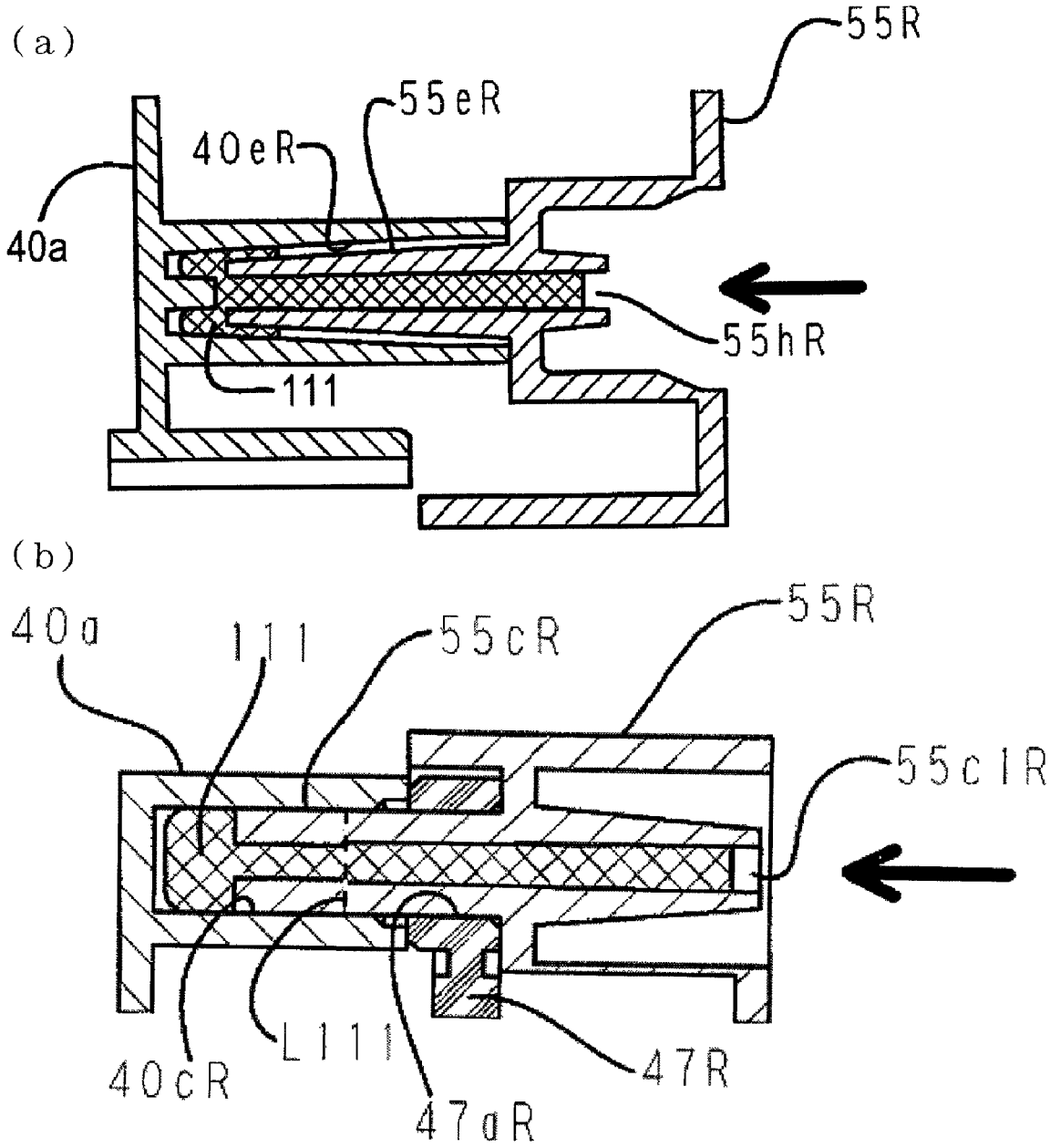
FIG. 11(*a*) is a sectional view of the connective portion of the second lengthwise end member, and the first connective hole of the second lengthwise end of the toner container, and FIG. 11(*b*) is a partially sectional view of the shaft of the second lengthwise end member, positioning hole of second lengthwise end of toner container, and bearing.

Next, the method for solidly attaching the second end member 55R will be described. FIG. 10(*a*) is a perspective view of the second end of the toner container 40*a*, and the second end member 55R, showing the method for solidly attaching the toner container 40*a* and second end member 55R to each other. For the ease of description, FIG. 10(*a*) shows only the second end of the toner supply container 40*a*, second end of the lid 40*b*, and second end member 55R. FIG. 11(*a*) is a sectional view of the connective portion 55*e*R of the second end member 55R, and the connective hole 40*e*R of the second end of the toner container 40*a*.

The second end member 55R supports the bearing 47R, and the second end of the magnetic roller 41*a*. It is solidly bonded to the second end of the toner container 40*a*.

The second end of the toner container 40*a* is provided with a positioning hole 40*c*R, a positioning hole 40*d*R, a first connective hole 40*e*R, and a second connective hole 40*f*R. The positioning holes 40*c*R and 40*d*R are round blind holes.

The second end member 55R is provided with an arm 55*a*R, a shaft 55*c*R, and a shaft 55*d*R. The end portion of the arm 55*a*R is provided with a hole 55*b*R, which is parallel to the development roller 41 and is elongated in cross section. The shafts 55*c*R and 55*d*R project inward from the inward surface of the second end member 55R, and fit into the positioning holes 40*c*R and 40*d*R, respectively.

The shafts 55*c*R and 55*d*R are put through the top and bottom positioning holes 47*a*R (FIG. 7), one for one, and then, are fitted into the positioning holes 40*c*R and 40*d*R, respectively.

Further, the second end member 55R is provided with a supportive hole 55*g*R, which is roughly at the mid point between the shafts 55*c*R and 55*d*R. The supportive hole 55*g*R is for supplying the second end of the magnetic roller 41*a*, and is D-shaped in cross section.

Further, the second end member 55R is provided with a first connective portion 55*e*R and a second connective portion 55*f*R, the positioning of which is such that as the second end member 55R is precisely positioned relative to the toner container 40*a*, the first and second connective portions 55*e*R and 55*f*R align with the first and second connective holes 40*e*R and 40*f*R of the developing apparatus unit 40.

The first and second connective portions 55*e*R and 55*f*R are provided with through holes 55*h*R and 55*j*R, respectively.

Next, referring to FIG. 11(*a*), the process for bonding the second end member 55R to the toner container 40*a* with the use of the melted resin, by fitting the first connective portion 55*e*R of the second end member 55R into the first connective hole 40*e*R of the toner container 40*a*, will be described.

A preset mount of melted resin is injected into the gap between the wall of the connective hole 40*e*R of the toner container 40*a* and the connective portion 55*e*R, through the through hole 55*h*R, from the direction indicated by an arrow mark in FIG. 11(*a*), with the second end member 55R being precisely positioned relative to the toner container 40*a*. As the melted resin is injected, the portion of the wall of the connective hole 40*e*R, which came into contact with the body of melted resin 111 (cross-hatched portion), and the portion of the surface of the connective portion 55*e*R of the second end member 55R, which came into contact with the body of melted resin 111, melt. Then, as the areas of contact between the second end member 55R and toner container 40*a* cool down, the melted resin 111 solidifies, solidly bonding the second end member 55R and toner container 40*a* to each other. Similarly, the second connective portion 55*f*R is bonded to the wall of the connective hole 40*f*R, as another body of melted resin 111 is poured into the gap between the wall of the connective hole 40*f*R and connective portion 55*f*R (unshown).

As described above, the second end member 55R is solidly attached to the toner container 40*a* by the two positioning portions, with the use of the two bodies of melted resin.

Next, the method for ensuring that the shaft 55*c*R is solidly bonded to the surface of the positioning hole 40*c*R, with the use of bonding resin, will be described. FIG. 10(*b*) is a perspective view of the second end member 55R and its shaft 55*e*R.

FIG. 11(*b*) is a partially sectional view the shaft 55*c*R of the second end member 55R, and the bearing 47R having the positional hole 40*c*R.

First, referring to FIG. 10(*b*) which is an enlarged perspective view of the shaft 55*c*R of the second end member 55R, and its adjacencies, the shaft 55*c*R will be described. The shaft 55*c*R is provided with a through hole 55*c*1R, the axial line of which coincides with the axial line of the shaft 55*c*R. This hole 55*c*1R is for injecting melted resin. The diameter ϕ of its entrance (outward side) is 2 mm, and the diameter ϕ of is inward end (inward side) is 1.7 mm. In other words, the hole 55*c*1R is tapered. Further, the inward end portion of the shaft 5*c*R is provided with a slit 55*c*2R, which is the passage for the melted resin. The slit 55*c*2R is 1.5 mm in width and 4 mm in depth.

Next, referring to FIG. 11(*b*), the process for bonding the shaft 55*c*R to the wall of the positioning hole 40*c*R with the use of resin will be described. After the shaft 55*c*R is put through the positioning hole 47*a*R of the bearing 47R, it is fitted into the positioning hole 40*c*R.

Then, a preset amount of melted resin is injected into the gap between the shaft 55*c*R and the wall of the positioning hole 40*c*R through the through hole 55*c*1R from the direction indicated in FIG. 11(*b*) by the arrow mark. As the melted resin is injected, the portion of the toner container 40*a*, which is in contact with the body of melted resin 111 (cross-hatched portion), and the portion of the second end member 55R, which is in contact with the body of melted resin 111, melt. Then, as the body of melted resin 111 is allowed to cool down, the melted resin 111 solidifies, solidly bonding thereby the shaft 55*c*R to the wall of the positioning hole 44*c*R. As described above, the shaft 55*c*R and the wall of the positioning hole 40*c*R, which are for precisely positioning the second end member 55R and toner container 40*a* relative to each other, are bonded to each other with the use of melted resin, leaving therefore no gap between the shaft 55*c*R and the wall of the positioning hole 40*c*R. Therefore, it is ensured that the bearing 47R remains solidly attached to the toner container 40*a*.

(Method for Disassembling Cartridge)

The cartridge 2 is mounted in the apparatus main assembly 1 of an image forming apparatus to be used for image formation. Thus, as the image forming apparatus is used for image formation, the toner T stored in the toner storage chamber 45 is consumed. That is, as the image forming apparatus is repeatedly used for image formation, the amount of the toner T gradually reduces.

Thus, the cartridge 2 is provided with a means (unshown) for detecting the remaining amount of toner in the cartridge 2. The detected amount of the remaining toner T is compared by the control circuit (unshown) of the apparatus main assembly 1 with a preset set threshold value for informing or warning a user of the remaining length of the service life of the cartridge 2.

As the detected amount of the remaining toner T falls below the threshold value, the control circuit displays the information or warning regarding the remaining length of the service life of the cartridge 2, on the monitor (unshown) of the image forming apparatus, prompting thereby a user to prepare a replacement cartridge 2, or replace the cartridge 2 in the apparatus main assembly 1, to ensure that the image forming apparatus remains above a preset level in terms of image quality.

A used cartridge 2, more specifically, a cartridge having run out of toner, is recovered, and remanufactured; it is cleaned, and is filled with a fresh supply of toner after its worn or broken components are replaced. Alternatively, a substantial number of used cartridges 2 are collected and disassembled. Then, their components are sorted. Those deemed reusable are cleaned to be reused, whereas those deemed unusable are sorted according to the types of the material of which they are formed, and are used as the materials for cartridge production (material recycle).

Next, the process of removing the magnetic roller 41*a* and charge roller 12, which are examples of the reusable components (processing means) of the process cartridge 2, will be described.

(i) First Separation Process

Figure 12:
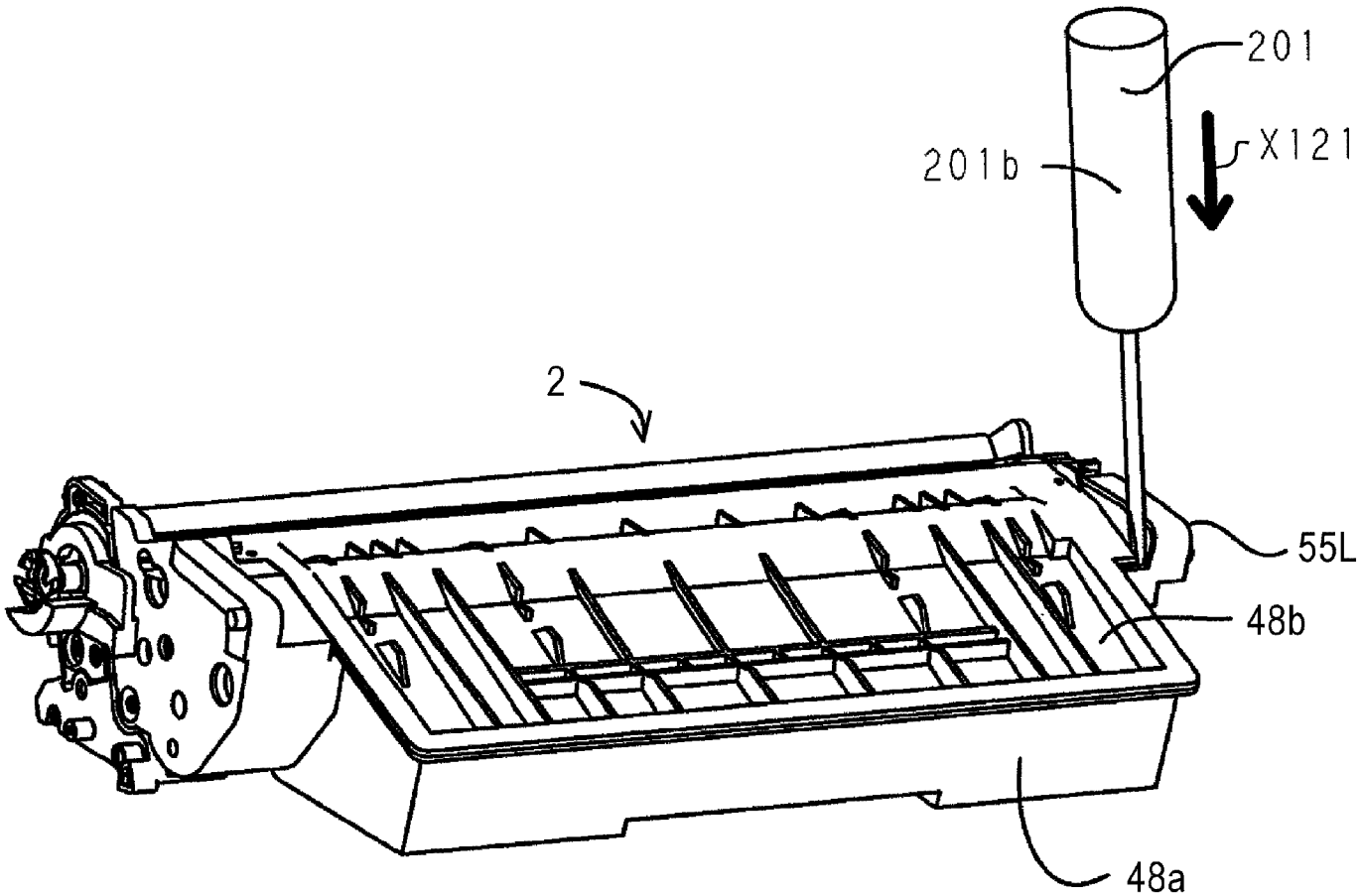
FIG. 12 is a perspective view of the process cartridge and a tool, showing the process for separating the first lengthwise end members from the toner container.
Figure 13:
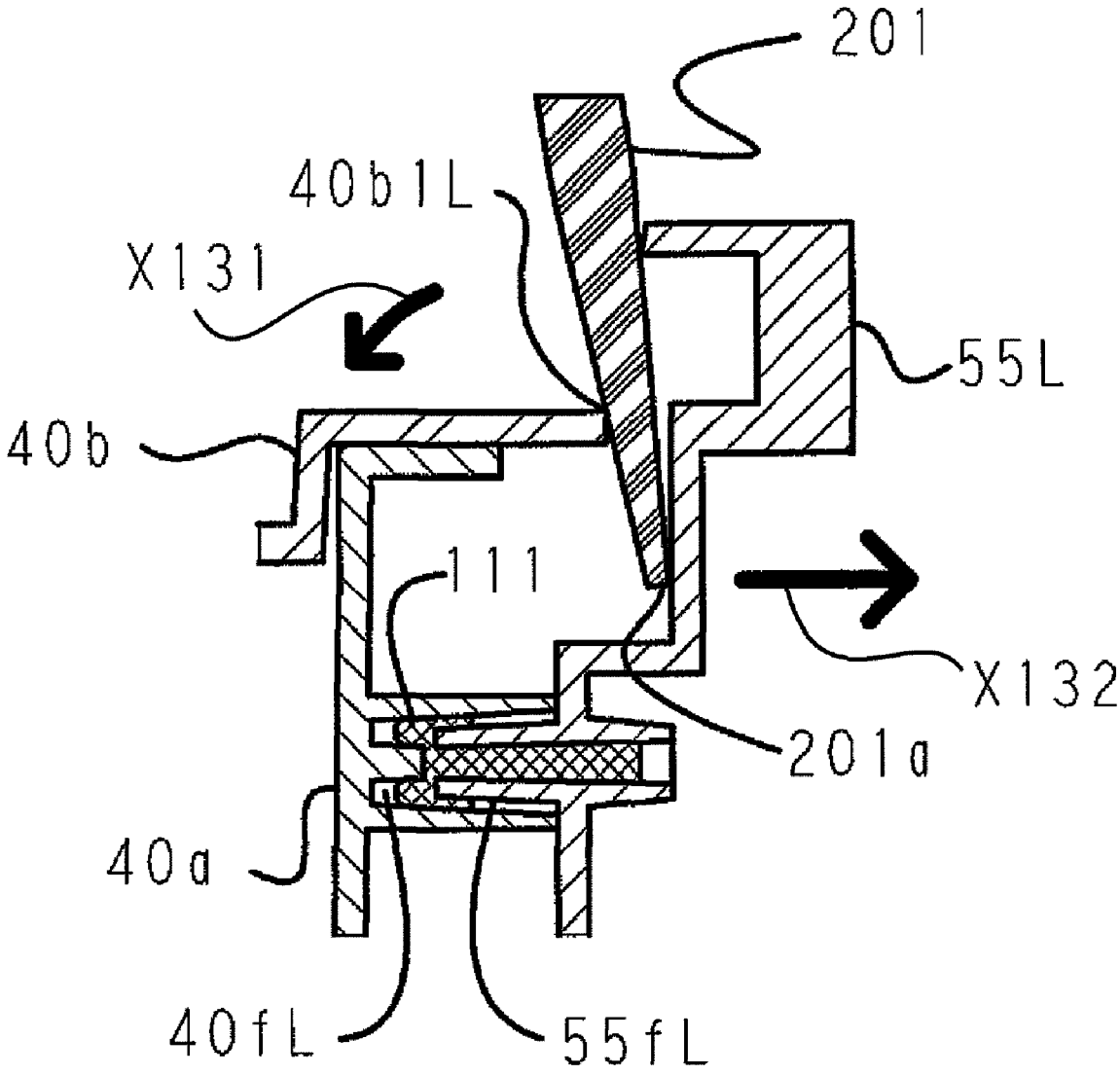
FIG. 13 is a sectional view of the first lengthwise end member and the first lengthwise end portion of the toner container, showing the process for separating the first lengthwise end member from the toner container.
Figure 14:
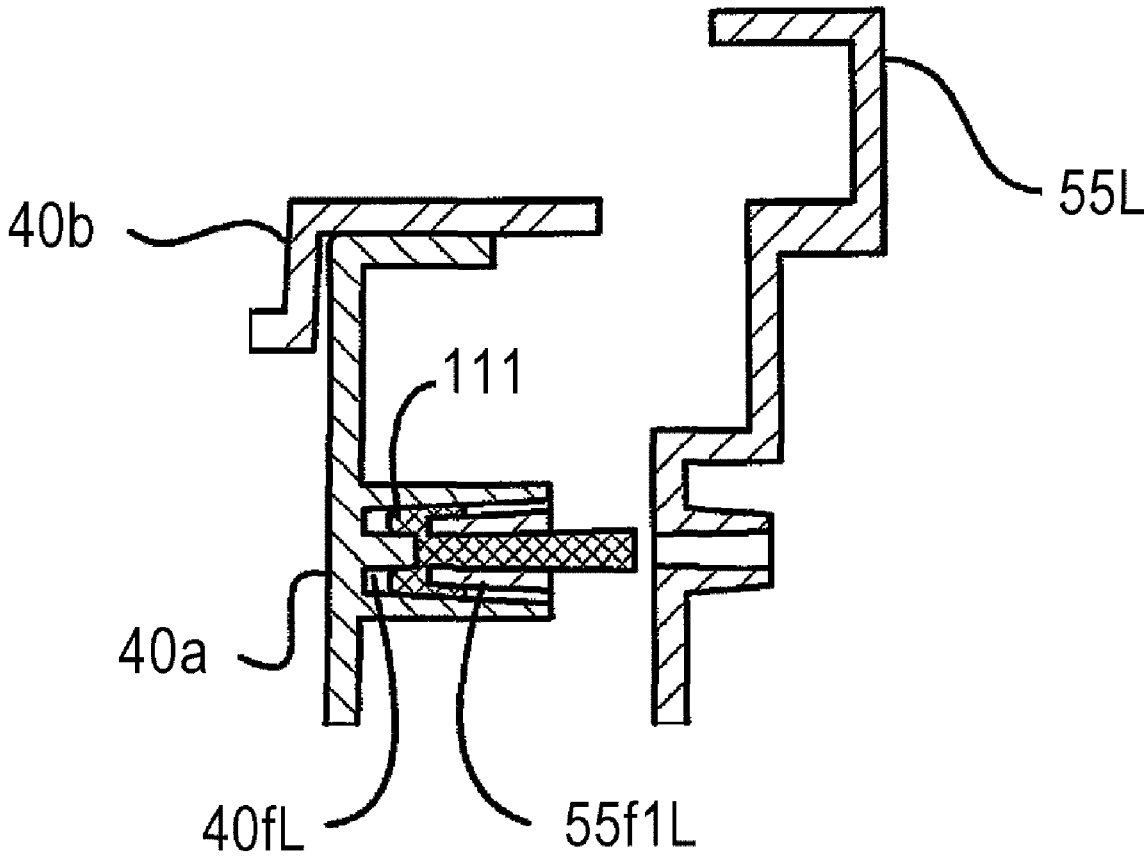
FIG. 14 is also a sectional view of the first lengthwise end member and the first lengthwise end portion of the toner container, showing the process for separating the first lengthwise end member from the toner container.
Figure 15:
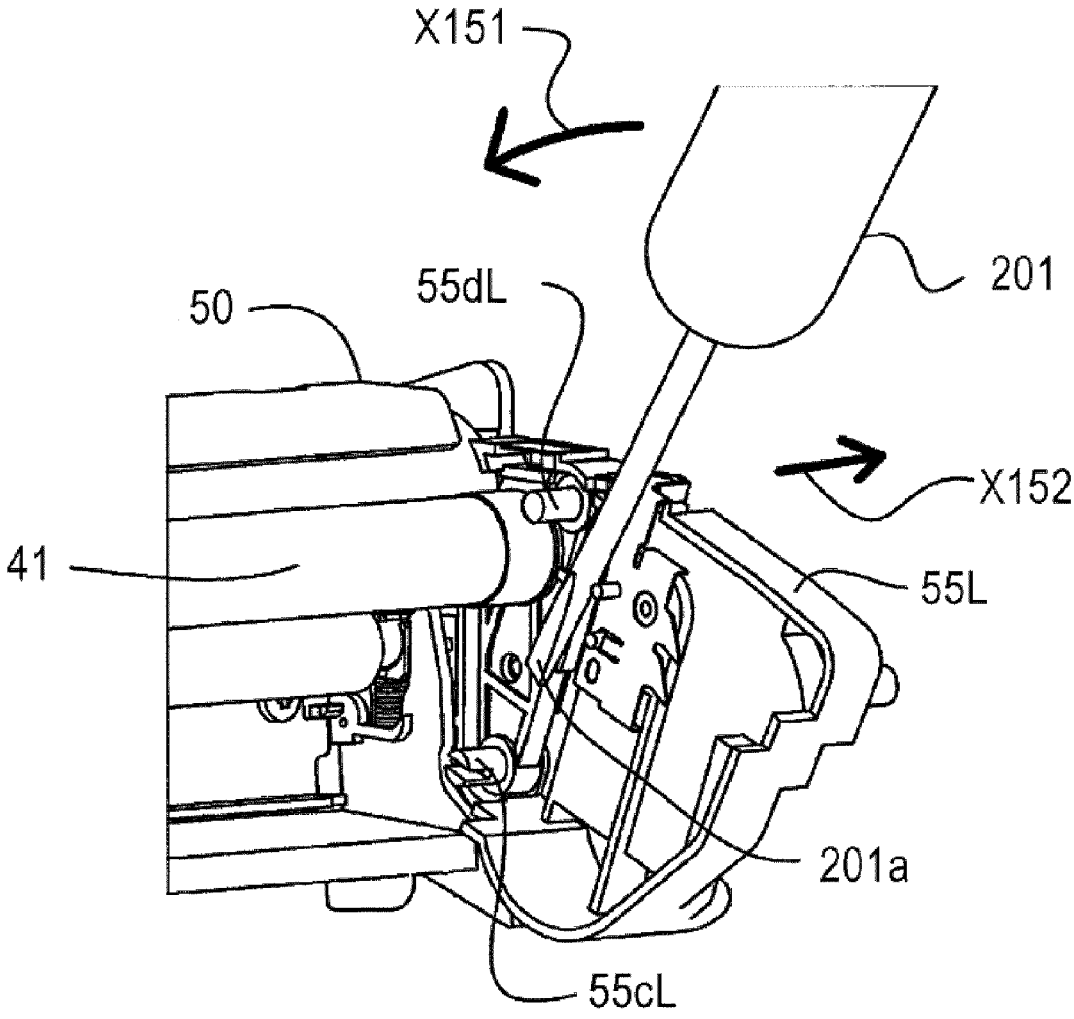
FIG. 15 is a perspective view of the first lengthwise end member, the first lengthwise end portion of the toner container, and the tool 201, showing the process for separating the first lengthwise end member from the toner container.

This process will be described with reference to FIG. 12. FIG. 12 is a perspective view of the process cartridge and a tool 201, and shows the process for separating the lengthwise end members 55L (55R) from the toner container 40*a*. FIG. 13 is a sectional view of the first end member 55L and the first end portion of the toner container 40*a*, and shows the process for separating the first end member 55L from the toner container 40*a*. FIG. 14 is also a sectional view of the first end member 55L and the first end portion of the toner container 40*a*, and shows the process for separating the first end member 55L from the toner container 40*a*. FIG. 15 is a perspective view of the first end member 55L, the first end portion of the toner container 40*a*, and the tool 201, and shows the process for separating the first end member 55L from the toner container 40*a*. Next, using FIGS. 12-15, the first separation Process will be described.

The first step to be carried out to disassemble the cartridge 2 is to disconnect the first end member 55L from the toner container 40*a*. This step is the first separation step.

First, the cartridge 2 is to be placed on a workbench, in such an attitude that the lid 48*b* faces upward. Then, the tool 201 (flathead screw driver, for example) having a sharp tip is to be inserted into the gap between the lid 48*b* and the first end of the toner container 40*a*, and the gap between the first end member 55L and the first end of the toner container 40*a*, in the direction indicated by an arrow mark X121, far enough for the tip of the tool 201 to reach the adjacencies of the second connective portion 55*f*L (FIG. 12).

FIG. 13 is a sectional view of the tool 201, second connective portion 55*f*L, and second connective hole 40*f*L after the tip of the tool 201 reached the adjacencies of the second connective portion 55*f*L.

After the insertion of the tool 201, the tool 201 is to be tilted in the direction indicated by an arrow mark X131 in FIG. 13. As the tool 201 is tilted, the tool 201 functions as a lever, the fulcrum of which is the tip 40*b*1L of the first end of the lid 40*b*. Thus, the tip 201*a* of the tool 201 presses the first end member 55L in the direction indicated by an arrow mark 132X.

As described above, the wall of the second connective hole 40*f*L and the second connective portion 55*f*L is solidly bonded to each other with the resin. However, as the first end member 55L is pressed by the tip 201*a* of the tool 201, the second connective portion 55*f*L is broken off by the pressure applied by the tool 201, allowing thereby the first end member 55L to be separated from the toner container 40*a*. FIG. 14 shows the state of the second end of the toner container 40*a* and the first end member 55L after the breakage of the second connective portion 55*f*L.

More specifically, the second connective portion 55*f*L breaks at its base, and separates from the main structure of the first end member 55L, whereas the solidified resin 111 and the end portion 55*f*1L of the second connective portion 55*f*L, remain in the second connective hole 40*f*L of the toner container 40*a*. The same technique is to be used to separate (break free) the first connective portion 55*e*L from the first connective hole 40*e*L.

During the above described separation step, the distance between the handle 201*b* of the tool 201 and the tip 40*b*1L is greater than the distance between the tip 40*b*1 and the tip 201*a* of the tool 201. Thus, the first end member 55L can be easily separated from the toner container 40*a*, because the principle of leverage significantly reduces the amount of the force to be applied to the tool 201 to separate the first end member 55L from the toner container 40*a*.

After the two portions of connection between the toner container 40*a* and first end member 55L are broken, the shafts 55*c*L and 55*d*L of the first end member 55L, which are in the positioning holes 40*c*L and 40*d*L of the toner container 40*a*, are to be disengaged from the toner container 40*a*.

FIG. 15 shows the method for disengaging the shafts 55*c*L and 55*d*L from the toner container 40*a*. Incidentally, in order to show the position of the tip 201*a* of the tool 201, the toner container 40*a*, lid 40*b*, and the like components are not shown.

Referring to FIG. 15, the tool 201 is to be inserted into the cartridge 2 through the gap between the first end of the toner container 40*a* and the first end member 55L, far enough for the tip 201*a* of the tool 201 to reach roughly the mid point between the shafts 55*c*L and 55*d*L.

The first end member 55L is supporting the first end of the magnetic roller 41*a* by the supporting hole 55*g*L. Thus, it is desired that the first end member 55L is moved roughly in parallel to the lengthwise direction of the magnetic roller 41*a* to prevent the end portion of the magnetic roller 41*a* from being damaged.

Thus, the tip 201*a* of the tool 201 is to be pressed upon the portion of the bearing 47L, which is roughly the mid point between the shaft 55*c*L and 55*d*L of the bearing 47L so that the shafts 55*c*L and 55*d*L are evenly moved out of the corresponding connective holes.

More specifically, the tool 201 is to be tilted in the direction indicated by an arrow mark X151 in FIG. 15. As the tool 201 is tilted, the tip 201*a* of the tool 201 presses the first end member 55L in the direction indicated by an arrow mark X152 in FIG. 15, the tip of the first end of the lid 40*b* functioning as a fulcrum (unshown, but, similar to FIG. 13).

As a result, the length by which the shafts 55*c*L and 55*d*L are engaged in the positioning holes 40*c*L and 40*d*L, respectively, reduces, with the arm portion 55$a$L being deformed. Then, as the tool 201 is tilted enough for the gap to become as wide as 7 mm, that is, the length of engagement, the shafts 55$c$L and 55$d$L come out of the positioning holes 40$c$L and 40$d$L, respectively.

In a case where the shaft 55$c$L was bonded to the wall of the positioning hole 40$c$L with the use of melted resin, the shaft 55$c$L and body of the solidified resin 111 sever in the adjacencies (area indicated by dotted line L111 in FIG. 11($b$)) of the bottom of the slit 55$c$R, allowing the shaft 55$c$L from disengaging from the toner container 40$a$.

Thus, the bearing 47L becomes separated from the developer flange 41$b$ (FIG. 19), with which the first end portion of the development roller 41 is fitted, while remaining attached to the first end member 55L.

(ii) Second Separation Process

Figure 16:
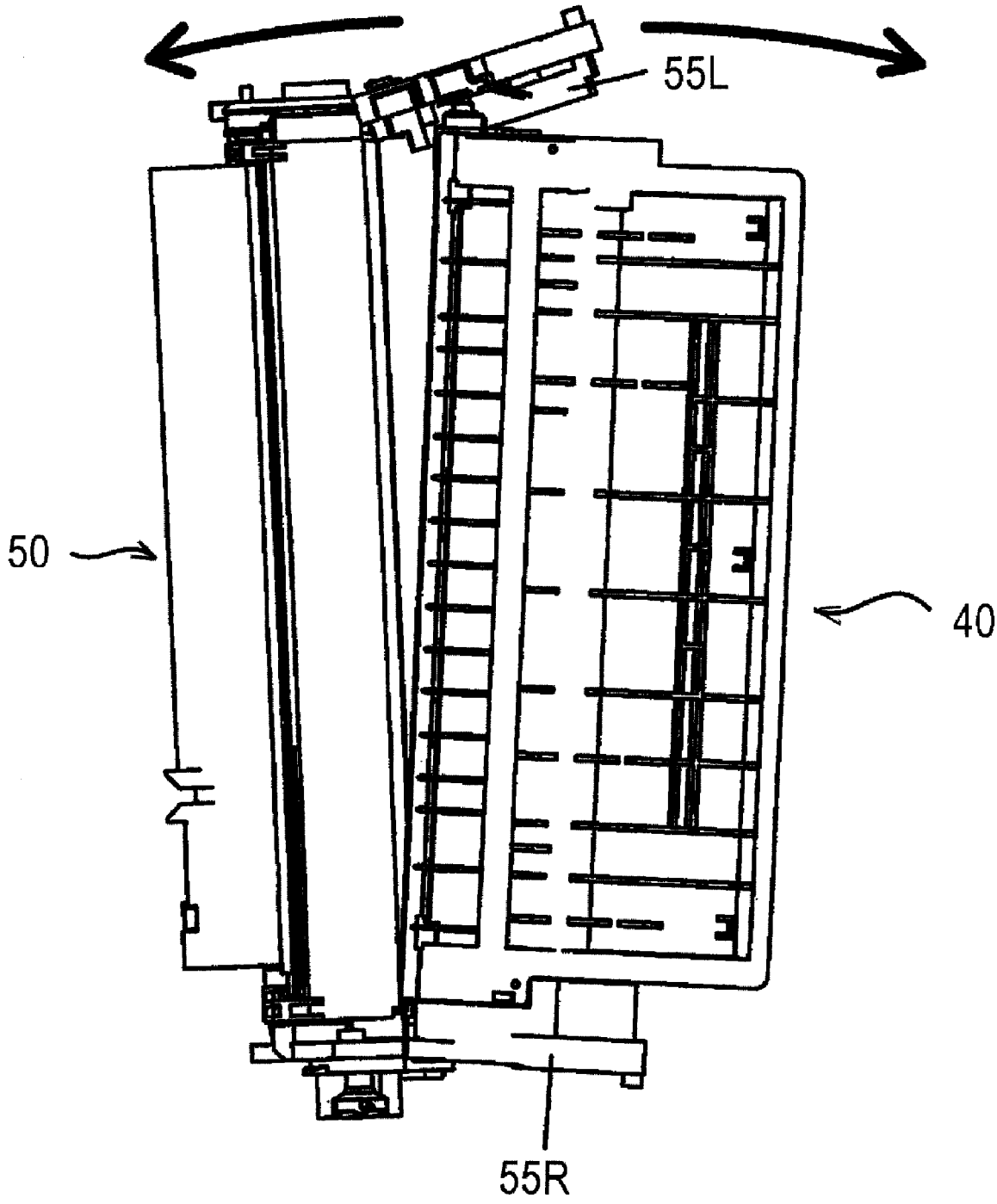
FIG. 16 is a plan view of the developing apparatus unit and photosensitive member unit, showing how the two units are to be separated from each other.
Figure 17:
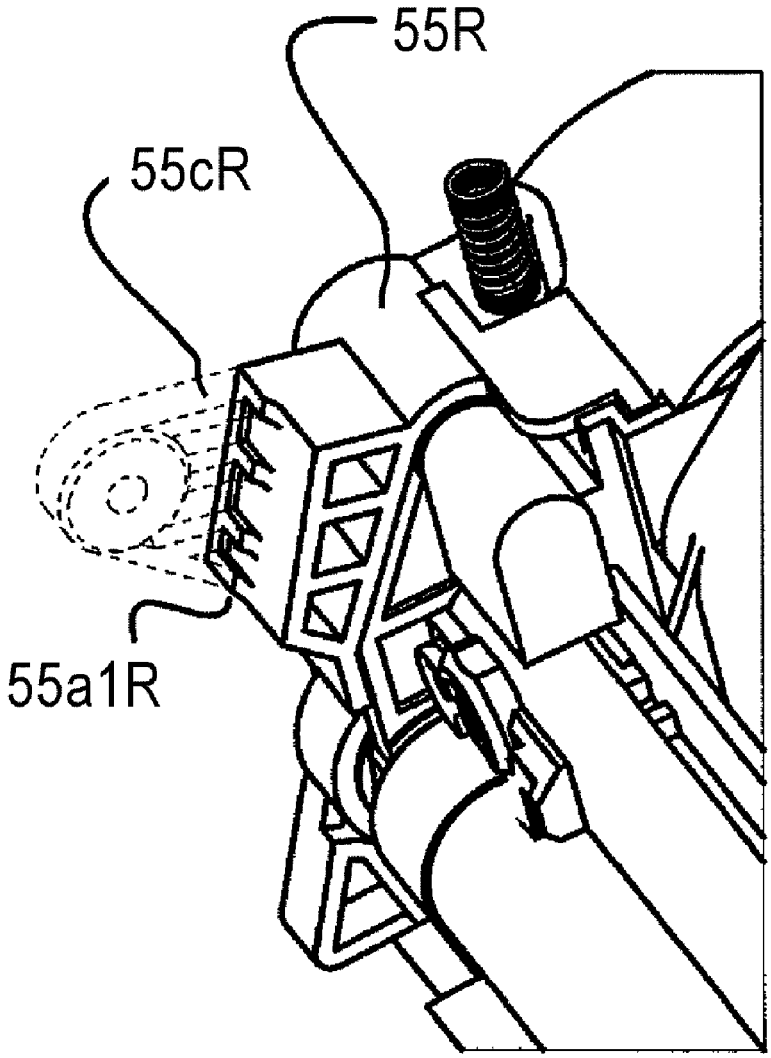
FIG. 17 is a perspective view of the second lengthwise end member.

FIG. 16 is a schematic drawing of the cartridge 2, which is for describing the operation to be carried out in the second separation process. FIG. 17 is a schematic drawing of the second end member 55R after the second end member 55R was broken through the second separation process.

Immediately after the completion of the first separation process, force is to be applied to the first end of the developing apparatus unit 40 and the first end of the photosensitive member unit 50 (in the directions indicated by arrow marks in FIG. 16) so that the distance, at the first end, between the photosensitive member unit 50, to which the first end member 55L is remaining attached, and the developing apparatus unit 40, from which the first end member 55L was disengaged, increases, with the first end member 55L being pushed outward in terms of the lengthwise direction of the toner container 40$a$.

(Tightly holding the development roller 41 to toner container 40$a$ during the above described process can prevent the unused toner T from leaking from the toner storage chamber 44).

As the abovementioned distance is increased, the arm portion 55$a$R of the second end member 55R, is deformed by the movement of the two units 40 and 50. Then, as the distance is continuously increased, the arm portion 55$a$R eventually severs.

Referring to FIG. 17, in which the toner container 40$a$ is on the top side, the breakage of the second end member 55R will be described. The arm portion 55$a$R has a step 55$a$1R, between the thin end portion and thick base portion. Thus, as the abovementioned distance is increased, the tensional stress concentrates on the base of the step, and therefore, the arm portion 55$a$R severs at the base of the step. The provision of this step reduces the amount of force necessary for the second separation process. Incidentally, right after the severance of the arm portion 55$a$R, the end portion of the arm portion 55$a$R, outlined by a dotted line in FIG. 17, is still remaining attached to the photosensitive member unit 50.

(iii) Process for Removing Development Roller

Figure 18:
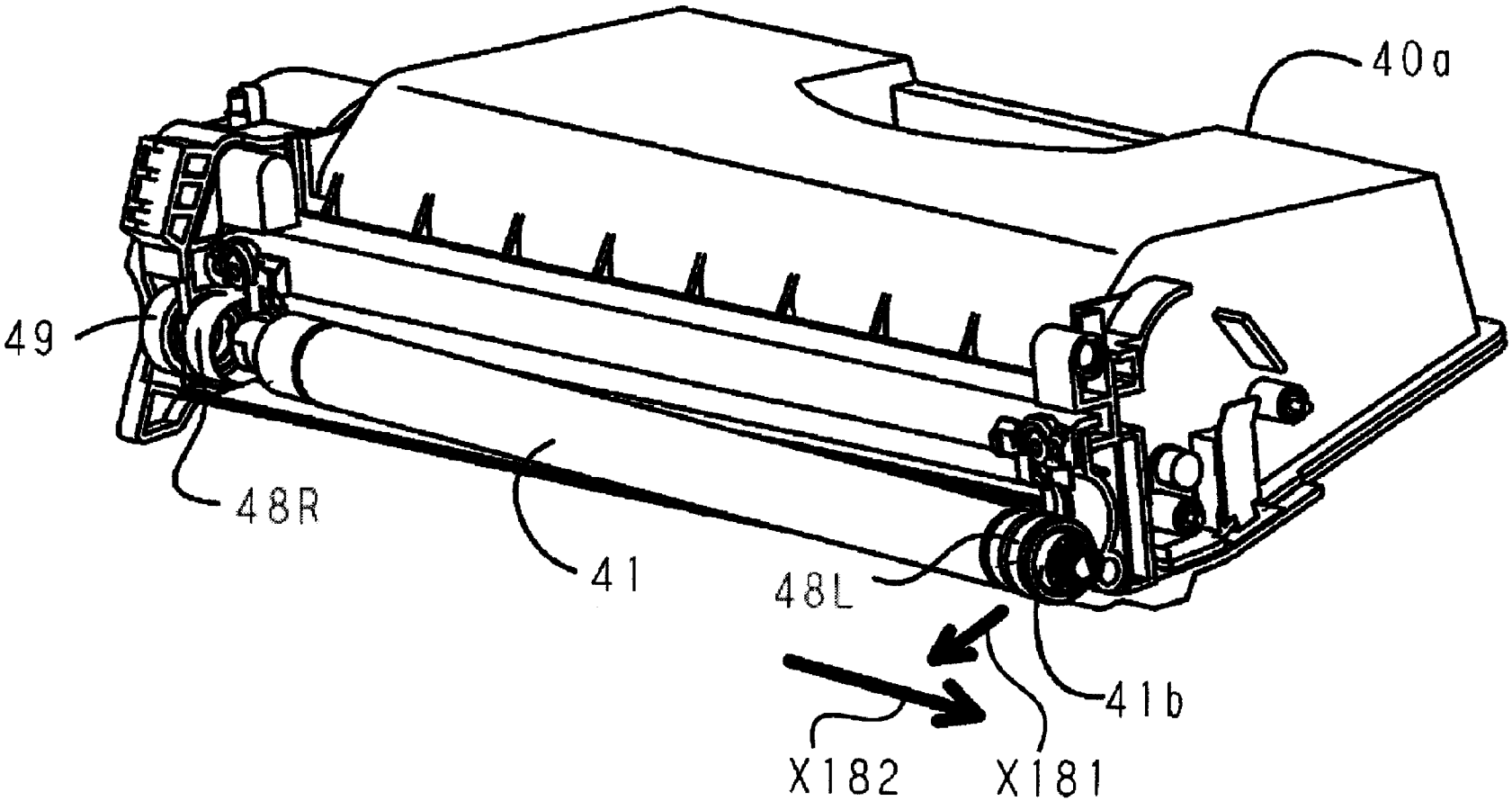
FIG. 18 is a perspective view of the toner container, development roller, and development roller gear, showing the operation for removing the development roller from the toner container.

FIG. 18 is a perspective view of the toner container 40$a$, and the development roller 41 which is being removed from the toner container 40$a$. It shows the process for removing the development roller 41 from the toner container 40$a$. The development roller 41 is to be held by the developer flange 41$b$ with which the first end of the development roller 41 is fitted. The first end of the development roller 41 can be easily separated from the toner container 40$a$ by pulling the flange 41$b$ in the direction indicated by an arrow mark X181 so that the development roller 41 rotationally moves about its second end. After the separation of the first end of the development roller 41 from the toner container 40$a$, the development roller 41 is to be slid in the direction indicated by an arrow mark X182. As the development roller 41 is slid in the above described direction, it easily separates from the toner container 40$a$.

During the above described steps, the gap maintaining first member 48L separates, along with the development roller 41, from the toner container 40$a$. However, the gap maintaining second member 48R and development roller gear 49 remain attached to the toner container 40$a$.

(iv) Process for Removing Magnetic Roller

Figure 19:
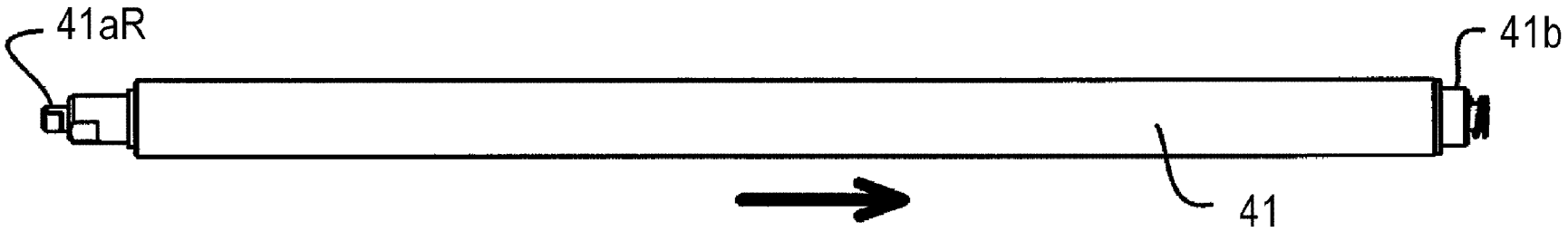
FIG. 19 is a schematic drawing of the development roller and magnetic roller, showing the operation for removing the magnetic roller from the development roller.
Figure 20:
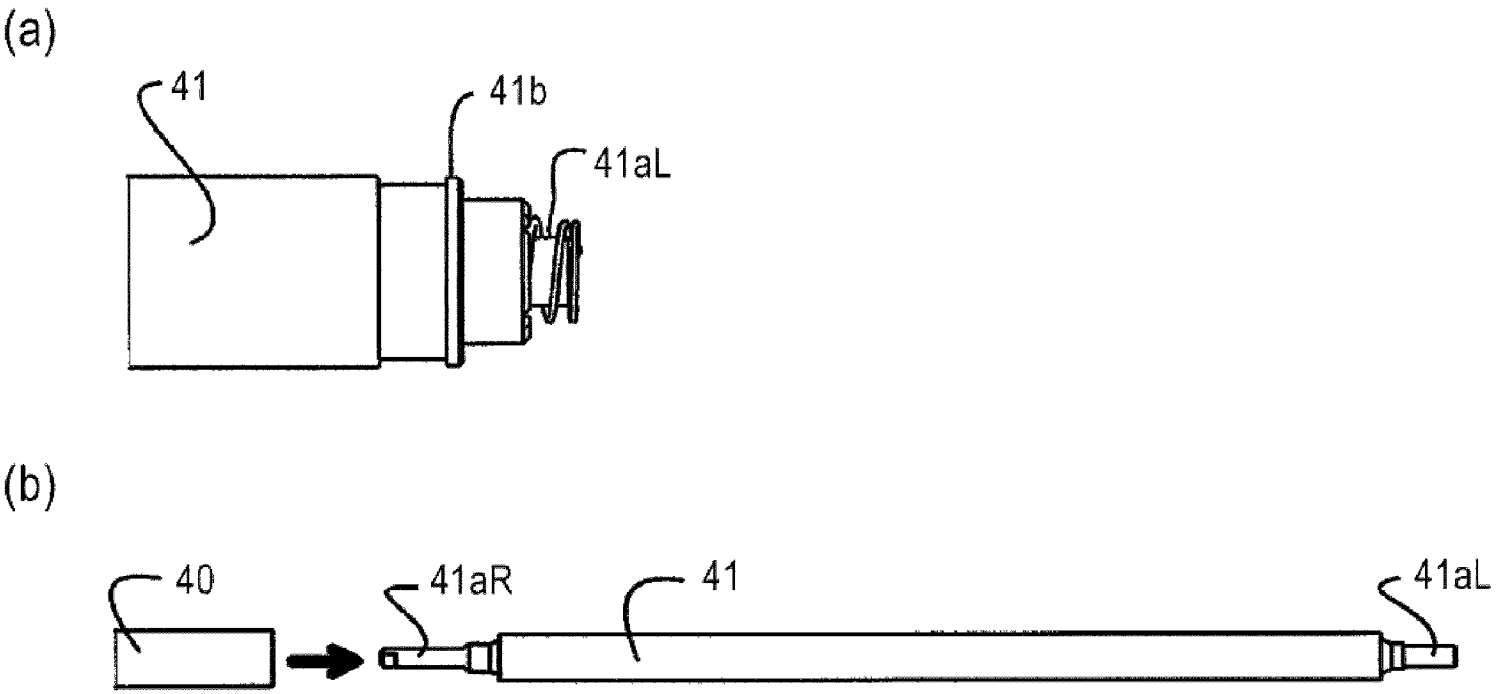
FIGS. 20(*a*) and 20(*b*) are schematic drawings of the development roller and magnetic roller, showing the operation for removing the magnetic roller from the development roller.

FIGS. 19 and 20 are schematic drawings of the developing apparatus unit 40 and development roller 41, respectively, which are for describing the process for removing the magnetic roller 41$a$ from the development roller 41. After the removal of the development roller 41 from the toner container 40$a$, the peripheral surface of the development roller 41 is still covered with the toner T, which is remaining held to the peripheral surface of the development roller 41 by the magnetic force from the magnetic roller 41$a$ in the development roller 41. Thus, the development roller 41 has to be cleaned (toner T is to be suctioned away, blown away, washed away, or removed by the like method).

Referring to FIG. 19, the second end portion 41$a$R of the magnetic roller 41$a$, which is supported by the wall of the supporting hole 55$g$R of the second end member 55R, is exposed from the second end of the development roller 41.

The disassembler is to hold the development roller 41, and press on the second end 41$a$R of the magnetic roller 41$a$ toward the first end of the development roller 41 (direction indicated by arrow mark). As the second end 41$a$R is pressed, the magnetic roller 41$a$ presses on the development roller flange 41$b$, which has remained solidly attached to (pressed into) the first end of the development roller 41. As a result, the development roller flange 41$b$ slides out of the development roller 41 as shown in FIG. 20($a$).

In the case of this embodiment of the present invention, the length by which the magnetic roller 41$a$ extends from the second end of the development roller 41 is 5 mm. Thus, as the second end portion 41$a$R of the magnetic roller 41$a$ is pressed into the development roller 41 by roughly 5 mm, it becomes possible for the disassembler to remove the development roller flange 41$b$ from the development roller 41 by grasping the development roller flange 41$b$ by hand.

Thereafter, the entirety of the magnetic roller 41$a$ can be moved out of the development roller 41 by pulling the magnetic roller 41$a$ by grasping the first end portion 41$a$L of the magnetic roller 41$a$, which is extending from the first end of the development roller 41 (FIG. 20($b$)).

The removed magnetic roller 41$a$ is reused after it is cleaned (by vacuuming, blowing, washing, wiping, etc.) and examined in terms of appearance and magnetic force, etc.

(v) Process for Removing Charge Roller

Example 1

Next, referring to FIGS. 21-24, the method for removing the charge roller 12 will be described.

Figure 21:
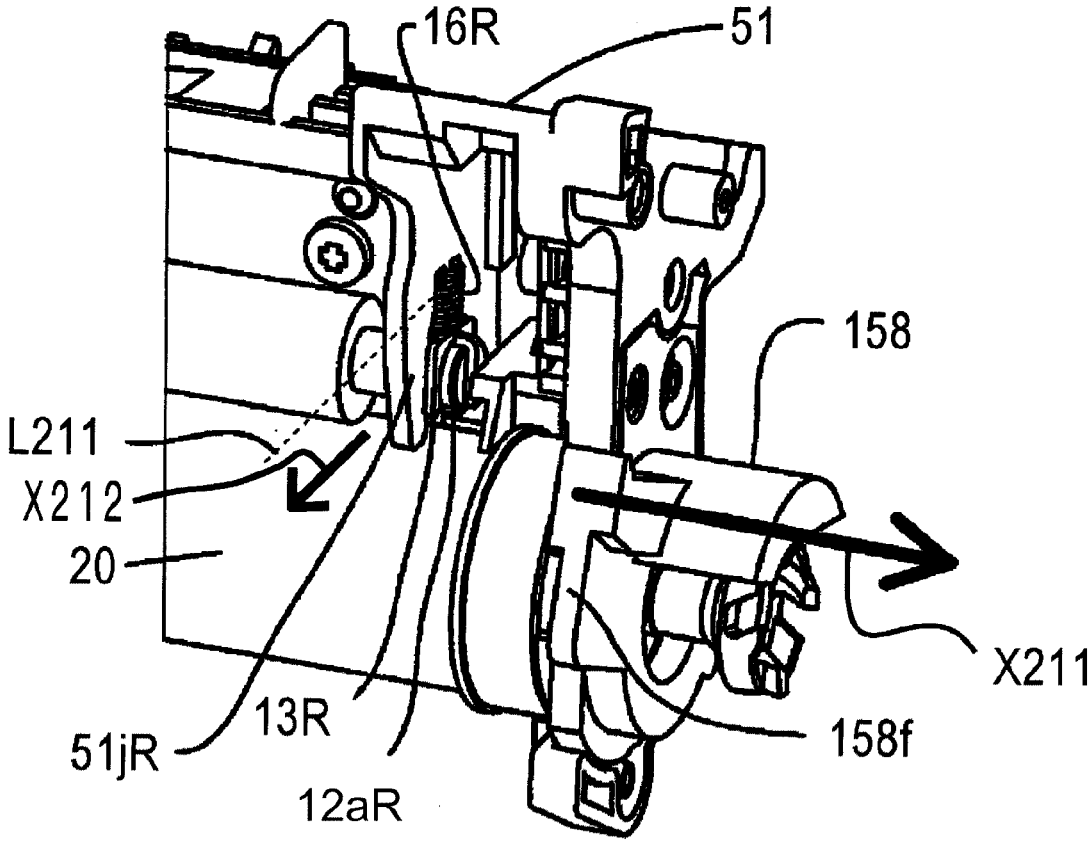
FIG. 21 is a perspective view of the second lengthwise end of the framework of the photosensitive member unit and drum bearing, showing how the drum bearing is to be removed.
Figure 22:
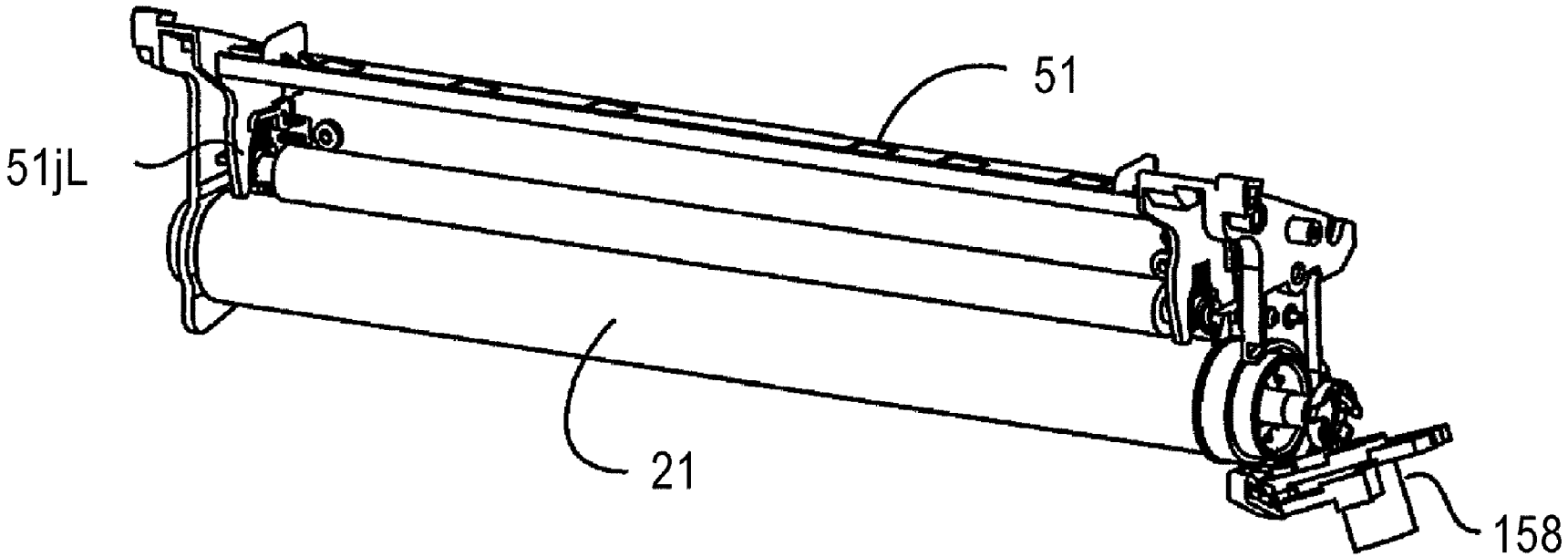
FIG. 22 is a perspective view of the framework of the photosensitive drum unit, drum unit, and drum bearing, showing how the drum bearing is to be removed from the drum unit framework.
Figure 23:
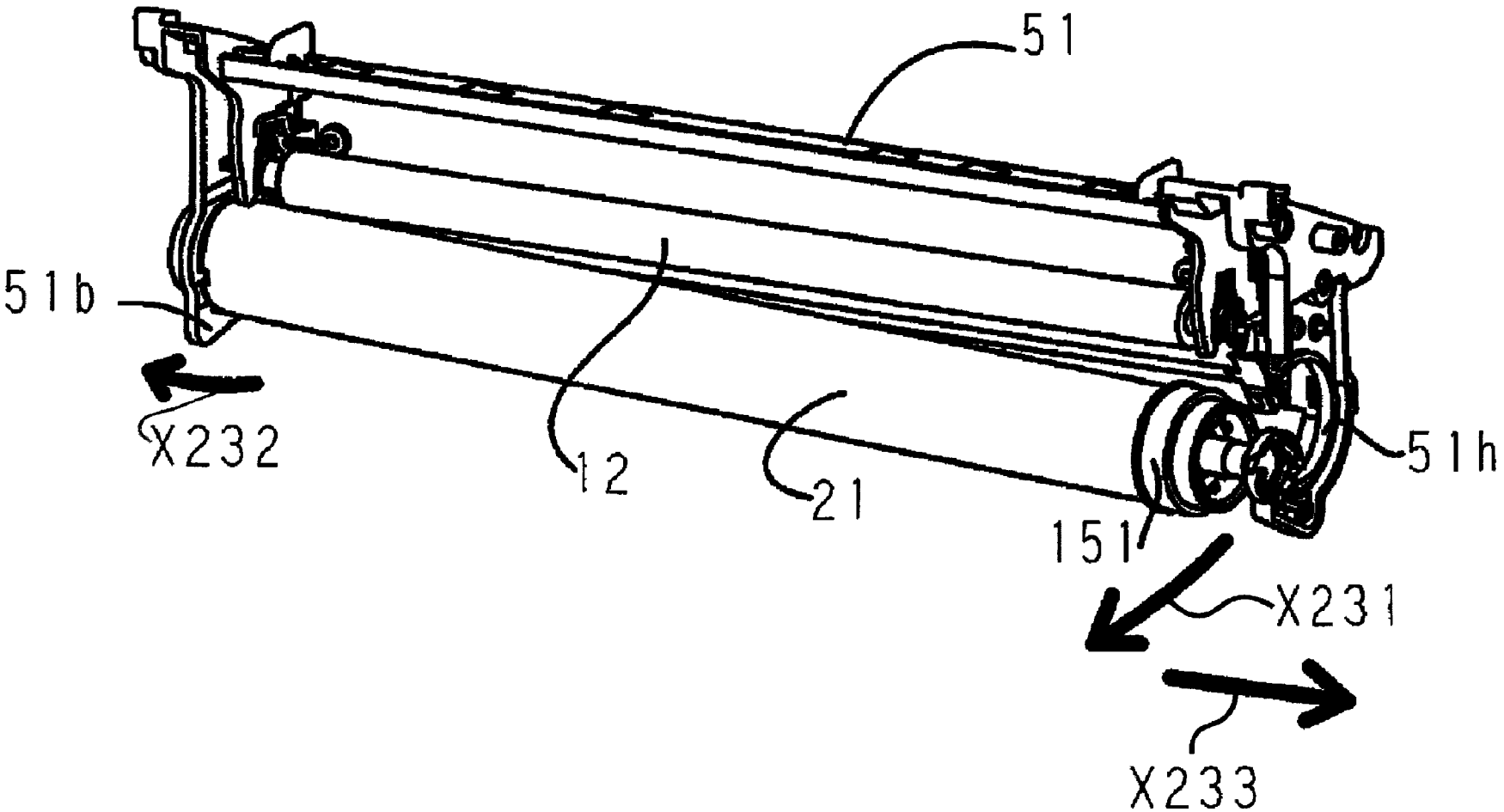
FIG. 23 is a perspective view of the drum unit framework, drum unit, charge roller, and drum flange, showing how the drum unit is to be removed from the drum unit framework.
Figure 24:
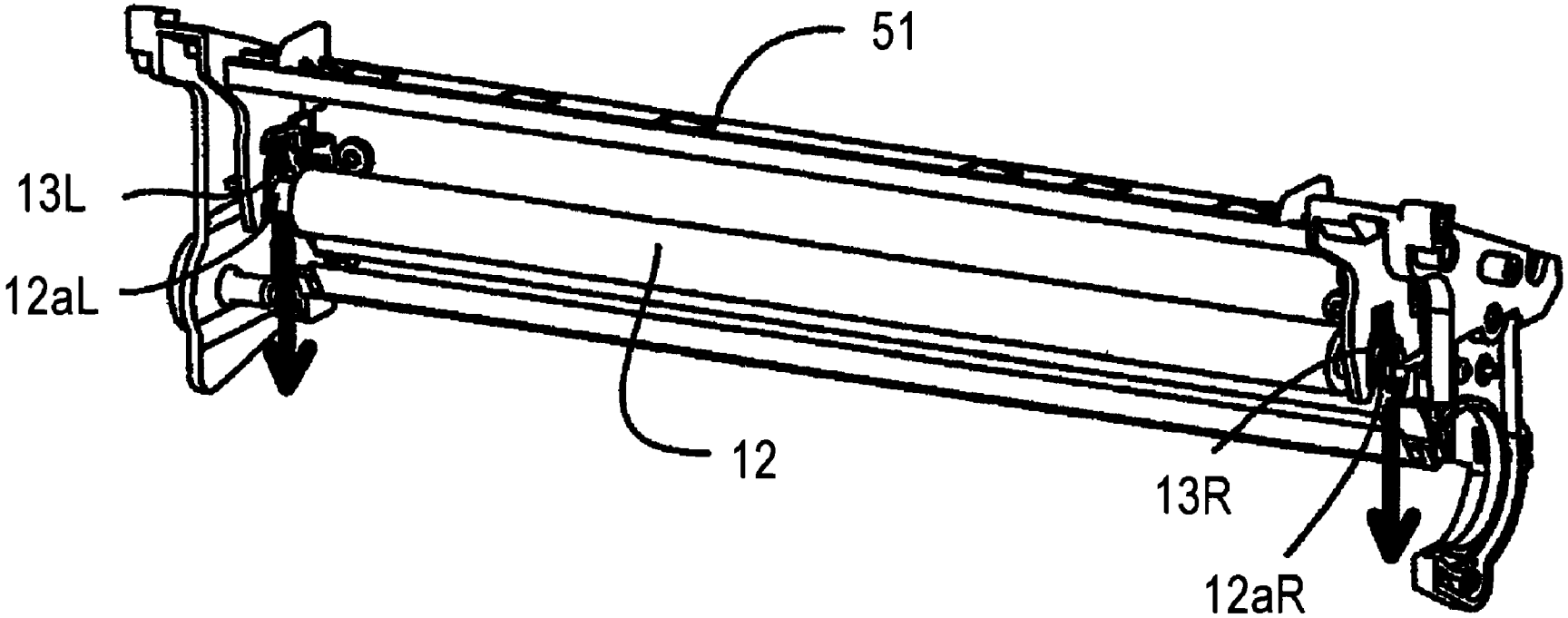
FIG. 24 is a perspective view of the drum unit framework, charge roller, and charge roller bearings, showing how the charge roller is to be removed from the drum unit framework.

FIG. 21 is a perspective view of the second end of the process cartridge, which is for describing the process for removing the bearing 158. FIG. 22 is a perspective view of the drum unit framework 51, drum unit 21, and bearing 158, and shows the process for removing the bearing 158. FIG. 23 is a perspective view of the charge roller 12, drum unit 21, drum unit framework 51, and flange 151, and shows the process for removing the drum unit 21 from the drum unit framework 51. FIG. 24 is perspective views of the charge roller 12, charge roller bearings 13L and 13R, and drum unit framework 51, and shows the process for removing the charge roller 12 from the drum unit framework 51. Next, referring to FIG. 21, the method for removing the bearing 158 of the drum unit 21 from the second lengthwise end of the drum unit framework 51, to which the bearing 158 was bonded, will be described.

First, the portion 158*f* of the bearing 158, which extends toward the developing apparatus unit 40 is to be pressed outward in terms of the lengthwise direction of the drum 20 (direction indicated by arrow mark X211).

Next, referring to FIG. 22, as the extension portion 158*f* is pressed, the joint between the first connective portion 158*d*1 of the bearing 158 and the first connective hole 51*g*1 of the drum unit framework 51 breaks. As the extension portion 158*f* is pressed further, the stress to which the base portion 158*g* (FIG. 5) of the second connective portion 158*d*2 of the drum bearing 158 is subjected becomes excessively large, causing the base portion 158*g* to bend and break.

Next, referring to FIG. 23, the method for removing the drum unit 21 from the drum unit framework 51 will be described. After the removal of the drum bearing 158, the drum unit 21 is to be tilted (in the direction indicated by arrow mark X231 in FIG. 23) so that the flange 151 moves through the hole 51*h* of the drum unit framework 51, which is C-shaped in cross section.

During the above described step, the first end portion of drum unit 21 is rotatably supported by the drum shaft 159 attached to the first end wall 51*b* of the drum unit framework 51 (side from which cartridge 2 is not driven), which was press-fitted in the hole of the first end wall 51*b*. Therefore, tilting the end wall 51*b*, that is, the end wall on the side from which the cartridge 2 is not driven, in the direction indicated by an arrow mark X232 makes it smoother for the drum unit 2 to be tilted in the direction indicated by the arrow mark X231.

Then, the drum unit 21 can be removed from the drum unit framework 51 by pulling the drum unit 21 toward the second lengthwise end of the drum unit framework 51 (direction indicated by arrow mark X233).

In order to prevent the drum unit 21 from rubbing against the charge roller 12, which is to be reused, it is desired that during the above described step, the drum unit 21 is rotated about its rotational axis (lengthwise axial line) while being pulled, or that it is pulled while it is kept substantially tilted in the direction indicated by the arrow mark X231.

Next, referring to FIG. 24, the method for removing the charge roller 12 will be described. After the removal of the drum unit 21, the charge roller 12 can be easily removed by moving the roller shaft portions 12*a*R and 12*a*L out of the charge roller bearings 13R and 13L, respectively, in the direction indicated by arrow marks in FIG. 23.

The removed charge roller 12 is cleaned (vacuuming, blowing, washing, wiping, and/or the like methods), and examined in appearance, magnetic force, etc., to determine whether it can be reused or not.

(vi) Process for Removing Charge Roller

Example 2

Figure 25:
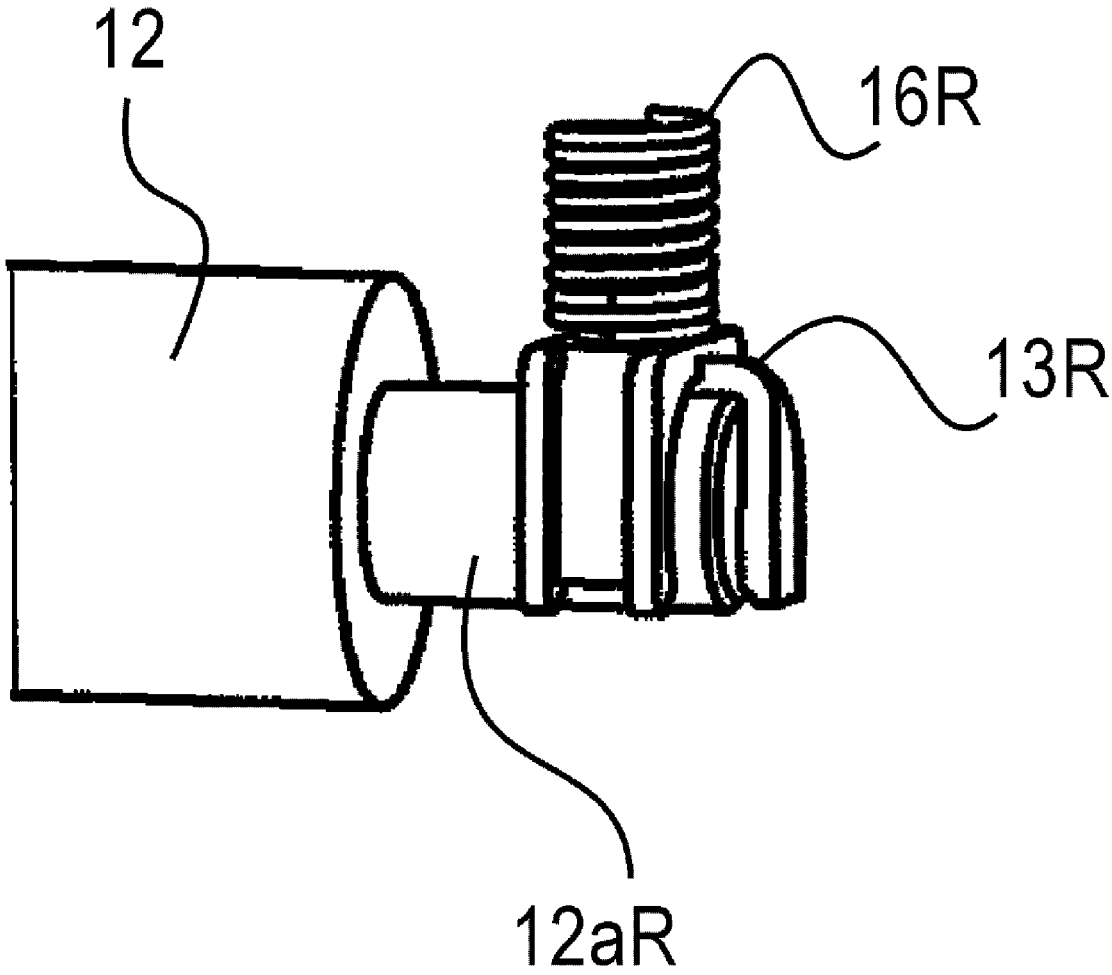
FIG. 25 is a perspective view of one of the lengthwise ends of the charge roller, and the corresponding charge roller bearing and spring, showing how the bearing and spring are to be removed from the charge roller.

Next, referring to FIGS. 21 and 25, the process (example 2) for removing the charge roller 12 will be described. FIG. 25 is a perspective view of the second end portion of the charge roller 2, the charge roller bearing 13R, and a spring 16R, and describes the process for removing the charge roller bearing 13R and spring 16R from the charge roller 12. Referring to FIG. 21, the shaft portion 12*a*R, that is, the shaft portion of the charge roller 12, which is on the first side, is rotatably supported by the charge roller bearing 13R.

Further, the charge roller bearing 13R is attached to the drum unit framework 51 in such a manner that it can be moved toward the drum 20 by the claw 51*j*R of the drum unit framework 51. It is kept pressed toward the rotational axis of the drum 20 by the spring 16R which is kept compressed between the charge roller bearing 13R and drum unit framework 51.

The claw 51*j*R is to be severed at the dotted line L211 in FIG. 21, that is, in the area which is close to its base and corresponds in position to the spring 16R (not charge roller bearing 13R). The claw 51*j*R, which is to be severed, is roughly 1.5 mm in thickness, and 7 mm in width. Therefore, it can be easily cut by a small nipper or the like.

Severing the second claw 51*j*R is sufficient to remove the charge roller 12.

However, in order to make it easier to remove the charge roller 12, the first claw 51*j*L also is to be severed (FIG. 22) in the same manner as is the second claw 51*j*R. With the claws 51*j* (51*j*R and 51*j*L) severed, there is no direct physical connection between the charge roller bearings 13 (13R and 13L) and drum unit framework 51. Therefore, the charge roller 12 can be removed in the direction indicated by the arrow mark X212.

During the above described process, the force generated by the compressed spring 16R and a corresponding compressed spring on the left side of the cartridge works in the direction to outwardly push the charge roller 12, making it easier to remove the charge roller 12.

Referring to FIG. 25, even after the removal of the charge roller 12, the charge roller bearing 13R, to which the spring 16R is remaining attached, is remaining attached to the shaft portion 12*a*R of the removed charge roller 12. Thus, the charge roller bearing 13R having the spring 16R is to be pulled outward (direction indicated by arrow mark), in terms of the lengthwise direction of the charge roller 12, away from the charge roller 12 (shaft portion 12*a*R).

Similarly, the first charge roller bearing 13L having a compressed spring configured and positioned on the left side of the cartridge to correspond to spring 16R is to be removed from the first end of the charge roller 12. This completes the process for removing the charge roller 12. The removed charge roller 12 is to be cleaned (vacuumed, blown, washed, wiped, etc.), and examined in appearance and magnetic force, etc., to determine whether it is reusable or not.

In the case of the above described embodiment of the present invention, the disassembly of a process cartridge can be started without removing the components connecting the developing apparatus unit 40 and photosensitive member unit 50. Thus, this embodiment can reduce the number of steps necessary to disassemble a process cartridge.

Given above is the detailed description of the process for removing the magnetic roller 41*a* and charge roller 12, which are the examples of the processing means (components) of the cartridge 2.

Further, the cleaning blade 52 and development blade 42 (developer regulating member), which were described as other processing means (components) with reference to FIGS. 4 and 7, may be removed from the cartridge 2 by removing the screws 58 and 59 with the use of a screw driver.

Further, described above was the method for disassembling the cartridge 2 by separating the first end member of the developing apparatus unit 40, that is, the end member in which the gears for rotationally driving the components related to the electrophotographic process are not located, from the toner container 40*a*, and then, disassembling the first end member.

Instead, however, the processing means may be removed by separating the developing apparatus unit 40 and photosensitive member unit 50 from each other, by separating the second end member 55R, that is, the opposite end member from the first end member, from the toner container 40*a*.

The cartridge disassembling method in the above described embodiment is significantly smaller in the number of steps necessary to remove components (processing means) from a process cartridge than those in accordance with the prior art.

Further, the cartridge disassembling method in the above described embodiment is significantly simpler in the steps for removing components (processing means) from a process cartridge than those in accordance with the prior art.

Further, the cartridge disassembling method in the above described embodiment does not require electrical tools to remove the lengthwise end members of the developing apparatus unit. Therefore, it is simpler in the steps for removing the processing means (components) from a process cartridge, and also, is smaller in power consumption, than those in accordance with the prior art.

Further, the cartridge disassembling method in the above described embodiment makes it possible to remove the components (processing means) from a process cartridge with no damages to the components.

(vii) Process for Sorting Remainders as Cartridge Materials

Next, the process for sorting the remainders of the cartridge 2 after the removal of the processing means will be described. The cartridge 2 is made of various substances, for example, metals, rubbers, resins, and the like. One of the substances, which is used as the fire-resistant material for a process cartridge, is high impact polystyrene (HIPS). Incidentally, the metals used as the materials for the process cartridge 2 are iron, aluminum, stainless steel, copper, etc. The rubbers used as the materials for the process cartridge 2 are silicon rubber, urethane rubber, etc. The resins used as the materials for the process cartridge 2 are foamed urethane, poly resin (POM), polyethylene (PE), polyethylene-terephthalate (PET), etc.

Next, the process for sorting these remainders according to their materials will be described. First, the remainders are to be broken up in a crusher made up of a steel vessel and a rotatable blade, while the particulate substances, such as toner, are recovered by vacuuming. As the rotatable blade is rotated by a driving means, the remainders of the cartridge 2 are scooped up and smashed against the wall of the container, by the blade, being thereby broken into pieces.

The remainders are crushed so that the resultant larger pieces are 10-30 cm in length, and smaller pieces are 1-5 cm in length (Step 1).

Next, the crushed remainders are sieved to eliminate toner, paper powder, and the minuscule plastic particles generated in the crushing step (Step 2).

Then, iron pieces are sorted out by a magnetic sorting means from the crushed and sieved remainders; the cleaning blade and drum shaft are sorted out (Step 3).

Next, small iron pieces, plastic magnets, and the like are sorted out by a drum magnetic separation process (Step 4), and members, such as the development sleeve, made of aluminum are sorted out by a sorting means based on eddy current (Step 5). Then, stainless steel components, and small metallic components made of metals other than stainless steel, are sorted out by a sorting process based on airflow (Step 6). After the completion of Steps 1-6, the remainders are further crushed (Step 7).

Thereafter, the labels, seals, and the like, which have adhered to the plastic pieces resulted from the crushing process are sorted out, and the minuscule plastic pieces are sorted out by the sorting process based on airflow (Step 8). Further, the remainders are sorted into metal pieces, polyethylene pieces, foamed urethane pieces, etc., by a gravity-based dry sorting process (Step 9).

After the completion of Step 9, the sorted pieces are further sorted according to their color by a color-based sorting process which uses color sensing (differentiating) element (color-based sorting process). The color sensing (differentiating) element reads the color density of the fragment to be sorted through a color-based sorting operation, in which a beam of light is projected upon a fragment to be sorted, and the color density of the fragment is read from the portion of the beam of light, which was reflected by the fragment. The read color density of the fragment is sent to the sorting controlling means, and compared to the referential value.

The sorting controlling means selects only the fragments, the color density of which is within a referential range, by repelling the fragments, the color density of which is outside the referential density range, by activating the pressurizing means according to the results of comparison. This method can remove resinous pieces other than the HIPS pieces, and other impurities, at a high level of accuracy to collect the HIPS pieces (Step 10).

Metallic fragments sorted according to color are to be subjected to a metal detection process to sort out metals (Step 11). Then, the fragments remaining after Step 11 are melted, cooled, and shredded to be used as the recycled plastics for manufacturing a process cartridge (Step 12).

The recyclable plastics obtained through Step 12 are mixed with brand-new plastics, melted, and molded as recycled plastics for manufacturing a process cartridge (Step 13).

Incidentally, Steps 12 and 13 may be switched in order. That is, the recyclable plastic fragments may be first mixed with brand-new plastic for a process cartridge, and then, may be melted, cooled, and shredded to yield the recycled plastic for a process cartridge.

As described above, in this embodiment, used process cartridges are recovered and disassembled. Then, the components removed from the process cartridges through the disassembly are sorted according to preset criteria. Then, the recovered components are used to manufacture process cartridges. Some of the recovered components are not recyclable for one reason or other, and therefore, are replaced with brand-new ones.

Further, the cartridge disassembling method in this embodiment is significantly smaller in the number of steps, and also, the amount of force necessary for the disassembly. Thus, the processing means (components), more specifically, the magnetic roller, developer regulating member (development blade), charge roller, and cleaning blade, can be easily removed.

Further, the cartridge disassembling method in this embodiment makes it easier to remove the processing means (components) from a cartridge, and also, makes it possible to remove the processing means (components) in the recyclable condition.

Further, in the above, the cartridge disassembling method in this embodiment was described regarding the steps for removing the magnetic roller, developer regulating member (development blade), charge roller, and cleaning blade. However, its application is not limited to the removal of the above-mentioned components from a process cartridge. That is, it can also be used, as necessary, to remove the other processing means (components) than those mentioned above.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 198423/2008 filed Jul. 31, 2008 which is hereby incorporated by reference.

What is claimed is:

1. A dismounting method for dismounting a magnet roller from a process cartridge detachably mountable to a main assembly of an electrophotographic image forming apparatus, the process cartridge including an electrophotographic photosensitive drum, a drum frame rotatably supporting one longitudinal end of the electrophotographic photosensitive drum, a drum bearing member rotatably supporting the other longitudinal end of the electrophotographic photosensitive drum and connected to the other longitudinal end of the drum frame by an adhesive, a developing roller for developing an electrostatic latent image formed on the electrophotographic photosensitive drum, the magnet roller being provided inside said developing roller and being movable in the longitudinal direction, a first side member supporting one longitudinal end of the magnet roller and connected to one longitudinal end of a developing device frame, and a second side member supporting the other longitudinal end of the magnet roller and connected to the other longitudinal end of the developing device frame, said method comprising:

a first separating step of inserting a tool between the first side member and the developing device frame and applying a force so as to separate the first side member and the developing device frame from each other;

a second separating step of expanding the distance between the one longitudinal end of the developing device frame and the one longitudinal end of the drum frame to separate the other longitudinal end of the developing device frame and the other longitudinal end of the drum frame from each other;

a developing roller dismounting step of dismounting the developing roller from the developing device frame; and a magnet roller dismounting step of dismounting the magnet roller from the developing roller by dismounting a flange from the developing roller by applying a force to a longitudinal end portion of the developing roller dismounted from the developing device frame in said developing roller dismounting step.

2. A dismounting method for dismounting a charging roller from a process cartridge detachably mountable to a main assembly of an electrophotographic image forming apparatus, wherein the process cartridge includes an electrophotographic photosensitive drum, the charging roller for electrically charging the electrophotographic photosensitive drum, a drum frame rotatably supporting one and the other longitudinal end of the charging roller through bearings and rotatably supporting one longitudinal end of the electrophotographic photosensitive drum, a drum bearing member rotatably supporting the other longitudinal end of the electrophotographic photosensitive drum and connected to the other longitudinal end of the drum frame by an adhesive, a developing roller for developing an electrostatic latent image formed on the electrophotographic photosensitive drum, a first side member connected to one longitudinal end of a developing device frame, and a second side member connected to the other longitudinal end of the developing device frame, said method comprising:

a first separating step of inserting a tool between the first side member and the developing device frame and applying a force so as to separate the first side member and the developing device frame from each other;

a second separating step of expanding the distance between the one longitudinal end of the developing device frame and the one longitudinal end of the drum frame to separate the other longitudinal end of the developing device frame and the other longitudinal end of the drum frame from each other; and a charging roller dismounting step of dismounting the charging roller from the drum frame.

3. A dismounting method according to claim 2, wherein said process cartridge further includes a magnet roller provided inside the developing roller, and the magnet roller is movable in the longitudinal direction, and wherein the first side member supports one longitudinal end of the magnet roller, and the second side member supports the other longitudinal end of the magnet roller.

* * * * *